US005321217A

United States Patent [19]

Traktovenko et al.

[11] Patent Number: 5,321,217

[45] Date of Patent: * Jun. 14, 1994

[54] APPARATUS AND METHOD FOR CONTROLLING AN ELEVATOR HORIZONTAL SUSPENSION

[75] Inventors: Boris G. Traktovenko; Clement A. Skalski, both of Avon; Richard L. Hollowell, Amston, all of Conn.

[73] Assignee: Otis Elevator Company, Farmington, Conn.

[ * ] Notice: The portion of the term of this patent subsequent to Jun. 2, 2009 has been disclaimed.

[21] Appl. No.: 731,291

[22] Filed: Jul. 16, 1991

Related U.S. Application Data

[63] Continuation-in-part of Ser. No. 555,131, Jul. 18, 1990, abandoned.

[51] Int. Cl.[5] ..... B66B 1/44

[52] U.S. Cl. ..... 187/115; 187/95; 187/1 R

[58] Field of Search ..... 187/100, 114, 115, 113, 187/134, 95, 1 R

[56] References Cited

U.S. PATENT DOCUMENTS

| | | | |
|---|---|---|---|
| 3,099,334 | 7/1963 | Tucker et al. | 187/95 |
| 3,669,222 | 6/1972 | Takamura et al. | 187/95 |
| 3,939,728 | 2/1976 | Rose et al. | 104/148 |
| 3,939,778 | 2/1976 | Ross et al. | 105/182.1 |
| 4,167,296 | 9/1979 | Dendy | 74/5 R |
| 4,215,403 | 7/1980 | Pollard et al. | 364/424 |
| 4,621,833 | 11/1986 | Soltis | 280/707 |
| 4,625,993 | 12/1986 | Williams et al. | 280/707 |
| 4,642,501 | 2/1987 | Kral et al. | 310/90.5 |
| 4,750,590 | 6/1988 | Otala | 187/95 |
| 4,754,849 | 7/1988 | Ando . | |
| 4,770,438 | 9/1988 | Sugasawa et al. | 280/707 |
| 4,809,179 | 2/1989 | Klinger et al. | 364/424.05 |
| 4,849,666 | 7/1989 | Hoag | 310/90.5 |
| 4,882,512 | 11/1989 | Andrus | 310/90.5 |
| 4,892,328 | 1/1990 | Kurtzman et al. | 280/707 |
| 4,898,257 | 2/1990 | Brandstadter | 180/9.1 |
| 4,899,852 | 2/1990 | Salmon et al. . | |
| 4,909,535 | 3/1990 | Clark et al. | 280/707 |
| 4,912,343 | 3/1990 | Stuart | 310/14 |
| 5,020,639 | 6/1991 | Michel . | |
| 5,086,882 | 2/1992 | Sugahava et al. | 187/95 |

FOREIGN PATENT DOCUMENTS

| | | | |
|---|---|---|---|
| 0033184 | 8/1981 | European Pat. Off. | B66B 7/04 |
| 0350582 | 1/1990 | European Pat. Off. . | |
| 0367621 | 5/1990 | European Pat. Off. . | |

(List continued on next page.)

OTHER PUBLICATIONS

"Development of an Inertial Profilometer", E. L. Brondenburg, et al., ENSCO, Incorporated, Prepared for: Federal Railroad Administration, Nov. 1974.

"Inertial Profilometer as a Rail Surface Measuring Instrument" by T. J. Rudd and E. L. Brondenburg, pp. 1-9.

(List continued on next page.)

*Primary Examiner*—Steven L. Stephan
*Assistant Examiner*—Robert Nappi
*Attorney, Agent, or Firm*—Francis J. Maguire, Jr.

[57] ABSTRACT

A method and apparatus for counteracting a disturbing force acting on an elevator platform in a hoistway comprises sensing the acceleration and position of the platform and applying a force between the platform and the hoistway in proportion to the magnitude of the acceleration signal, in proportion to the integral of the acceleration signal and in proportion to the position signal. The second position signal may be obtained from an electromagnet actuator wherein the sensed current may be divided by a sensed flux density signal multiplied by a transformation signal to obtain position. A force feedback signal may be obtained by squaring the flux density.

25 Claims, 24 Drawing Sheets

FOREIGN PATENT DOCUMENTS

| | | | |
|---|---|---|---|
| 0467673 | 1/1992 | European Pat. Off. | B66B 11/02 |
| 61-22675 | 11/1980 | Japan | B66B 7/08 |
| 60-15374 | 7/1983 | Japan | B66B 1/06 |
| 60-36279 | 8/1983 | Japan | B66B 7/04 |
| 58-39753 | 9/1983 | Japan | B66B 7/02 |
| 63-45768 | 9/1986 | Japan | B66B 13/06 |
| 63-87483 | 9/1986 | Japan | B66B 1/06 |
| 1-156293 | 12/1987 | Japan | B66B 11/02 |
| 1-197294 | 2/1988 | Japan | B66B 7/04 |
| 1-288591 | 5/1988 | Japan | B66B 11/08 |
| 2-3891 | 6/1988 | Japan | G08B 17/107 |
| 2-127373 | 11/1988 | Japan | B66B 1/26 |
| 2-198997 | 1/1989 | Japan | B66B 11/08 |
| 3-3884 | 1/1991 | Japan | B66B 7/06 |
| 3-3888 | 1/1991 | Japan | B66B 11/02 |
| 3-23185 | 1/1991 | Japan | B66B 11/02 |
| 3-51279 | 3/1991 | Japan | B66B 5/02 |
| 5-51280 | 3/1991 | Japan | B66B 5/02 |
| 3-51281 | 3/1991 | Japan | B66B 11/02 |
| 3-51285 | 3/1991 | Japan | B66B 11/02 |
| 3-88687 | 4/1991 | Japan | B66B 7/04 |
| 3-88690 | 4/1991 | Japan | B66B 11/02 |
| 1030728 | 5/1966 | United Kingdom . | |
| 2181275 | 4/1987 | United Kingdom . | |
| 2238404 | 5/1991 | United Kingdom | B66B 7/02 |

OTHER PUBLICATIONS

EPO Abstract, Database WPIL, Week 9030 Derwent Publications Ltd., London GB; AN90-224718 and FI--A-8804830 (Kone Elevator GmbH) Mar. 29, 1990.

Skalski, C. A.; "Performance of Magnetic Suspensions for High Speed Vehicles Operating over Flexible Guideways" from *Journal of Dynamic Meces. System & Control,* Jun. 1974.

U.K. Pat Appln. GB 2 238 404 A, "Reducing Cage Vibration in Lift", Hitachi Ltd., Applicant, publ. May 29, 1991.

"A Magnetic Bearing Control Approach using Flux Feedback" by N. Groom, published Mar. 1989, in *NASA Technical Memorandum* 100672.

*NASA Tech. Briefs,* "Flux-Feedback Magnetic-Suspension Actuator" Publ. Jul. 1990, pp. 44-45.

*Popular Science,* Sep. 1990 "Riding on Electrons" by Don Sherman pp. 74-77.

FIG. 44
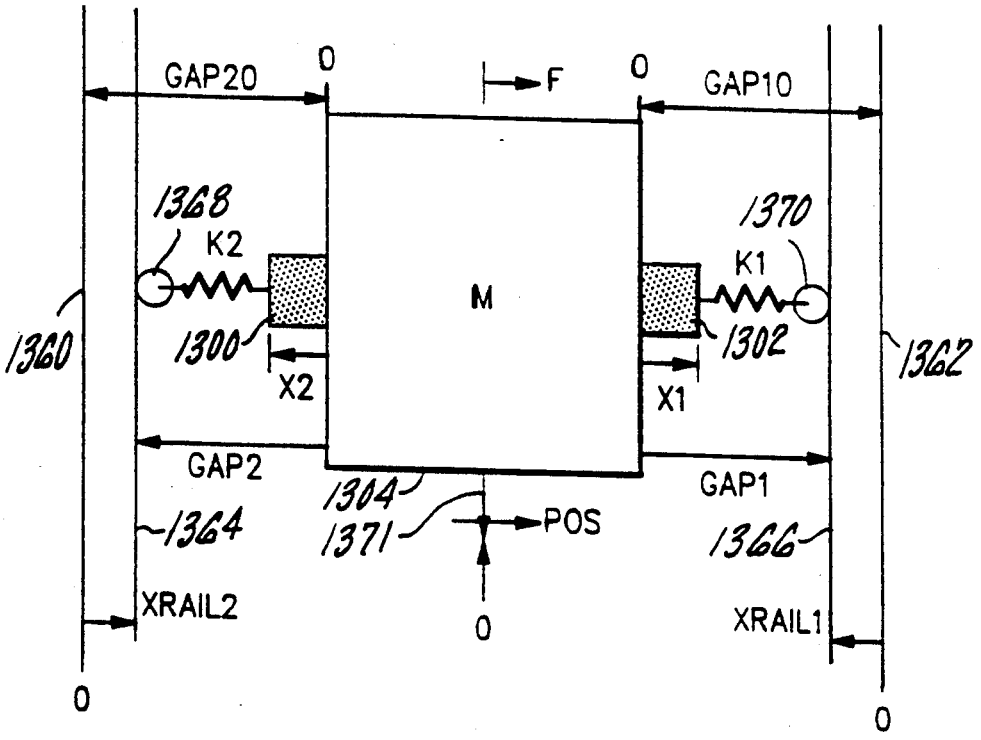
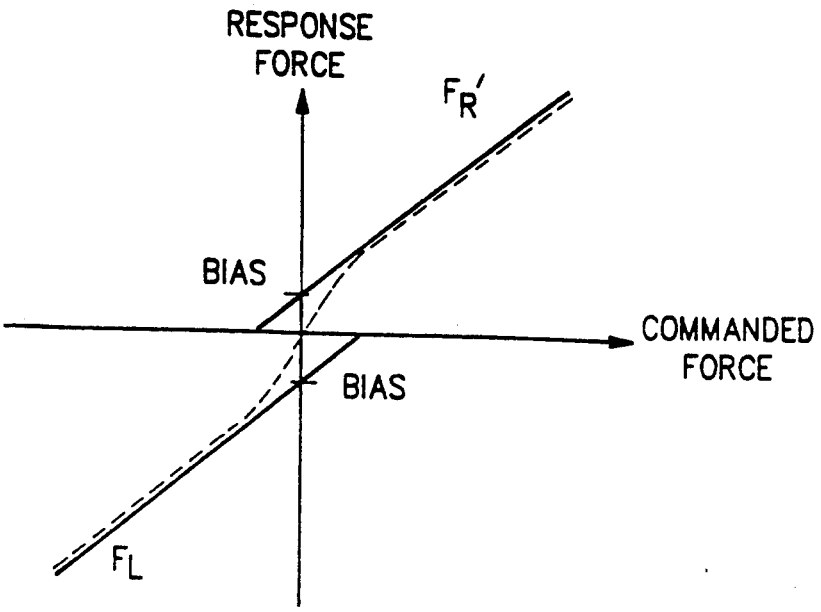
FIG. 41

FIG. 42A
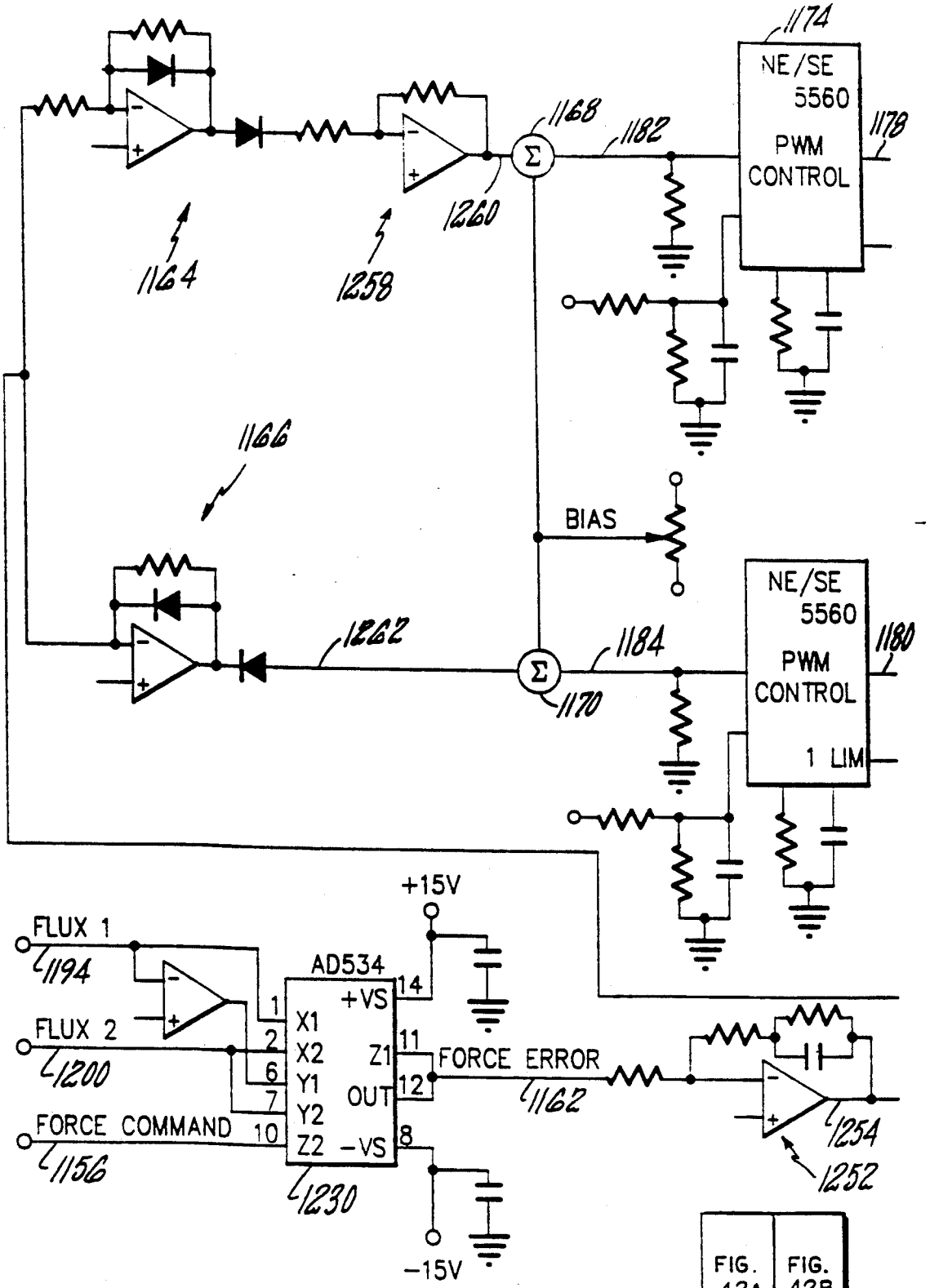
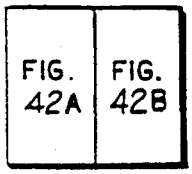
FIG. 42

APPARATUS AND METHOD FOR CONTROLLING AN ELEVATOR HORIZONTAL SUSPENSION

This is a continuation-in-part of co-pending application Ser. No. 07/555,131 filed on Jul. 18, 1990, now abandoned.

RELATED APPLICATIONS

This application discloses subject matter which may be disclosed and claimed in commonly owned, copending applications U.S. Ser. No. 07/555,135 entitled "Active Control of Elevator Pendulum Car", U.S. Ser. No. 07/555,133 entitled "Elevator Rotational Control", U.S. Ser. No. 07/555,140 entitled "Y-Shape Section for Elevator Guide Rail", U.S. Ser. No. 07/555,130 entitled "Active Control of Elevator Platform", and U.S. Ser. No. 07/555,132 entitled "Elevator Active suspension system".

TECHNICAL FIELD

This invention relates to elevators and, more particularly, to a control for providing a smooth ride for an elevator passenger platform.

BACKGROUND ART

In a non-pendulum car disclosure, U.S. Pat. No. 4,754,849, Hiroshi Ando shows electromagnets disposed outside the car symmetrically about guide rails in a control system using opposing forces from the electromagnets to keep the car steady using the rails as the necessary ferromagnetic mass but, rather than using the rails as a straight reference line, instead using a cable stretched between the top and bottom of the hoistway. The position of the car with respect to the cable is controlled using detectors in a closed loop control system. There is serious question as to whether such a cable can be successfully used as a reliable guide of straightness. Moreover, the Ando disclosure requires the use of a large number (twelve) of electromagnets with separate control and power circuits. Furthermore, the use of guide rails such as are disclosed by Ando will require fairly massive coils in order to generate the large amount of flux density required, given the (i) not insignificant force required to move the weight of the elevator car, (ii) the necessarily small utilizable surface area on the rail, and (iii) the relatively large air gap required as compared to the rail thickness.

In another non-pendulum car disclosure, U.S. Pat. No. 4,750,590, Matti Otala discloses what appears to be an essentially open loop control system with solenoid actuated guide shoes that uses the concept of memorizing the out-of-straightness of the guide rails for storage in a computer memory and then sensing the position of the car in the hoistway for the purpose of recalling the corresponding information from memory and correcting the guide rail shoe positions accordingly. An acceleration sensor is mentioned in claim 6 but does not appear to be otherwise disclosed as to its purpose in the specification or drawing. Perhaps it is used to determine the acceleration of the car in the hoistway. Such an acceleration signal would presumably be needed to determine which data point to retrieve from memory as suggested in claim 2. Otala's approach suffers from the problem of changes in the out-of-straightness before a correction run can be effected and the accuracy with which the stored information can be made to conform to the car's actual position.

A mounting arrangement for a pendulum or hung car is shown in U.S. Pat. No. 4,113,064 by Shigeta et al wherein the car is suspended within and from the top of an outer car framework by a plurality of rods connected to the bottom of the car. A plurality of stabilizing stoppers are shown interposed between the underside of the hung car and the floor of the car frame. Each stopper comprises a cylinder extending downward from the underside of the hung car surrounding a rubber torus placed on an upright rod extending from the floor of the car frame. Clearance between the cylinder and the hung car is sufficient to permit movement but insufficient to allow the hung car to strike the car frame. Another embodiment comprising "bolster" means having ball bearings permits movement in any direction of the horizontal plane.

Another approach is disclosed by Luinstra et al in U.S. Pat. No. 4,660,682 wherein a pair of parallel rails are arranged horizontally in a parallelogram between the suspended car and car frame with followers arranged to roll or slide on the rails in such a way that the hung car can move in any horizontal direction relative to the car frame.

Both of the last two pendulum or supported car approaches employ passive restraints on movement which by nature are reactive rather than active.

DISCLOSURE OF THE INVENTION

An object of the present invention is to provide a novel rail for an active control for an elevator car.

According to the present invention an elevator car undergoing movements in moving up and down an elevator hoistway is controlled with respect to a selected parameter by a plurality of actuators acting on or with a pair of rails in a closed loop control system responsive to a plurality of sensors for detecting the selected or another, related parameter. Such parameters may include position, velocity, acceleration or other similar parameters, although acceleration is preferred.

In further accord with the present invention, the actuators may be arranged so as to counteract horizontal translational forces acting on the car moving in the hoistway. Without limitation, only two active actuators need be used near the bottom of the car. Two conventional or passive guides might additionally be used near the top of the car. Such an arrangement might advantageously employ, e.g. but not limited thereto, a nonconventional rail shape, e.g., a shape first suggested for other purposes by Charles R. Otis in U.S. Pat. No. 134,698 (which issued on Jan. 7, 1873).

In still further accord with the present invention, the actuators may be arranged so as to counteract rotational forces acting about vertical. Furthermore, and without limitation, if such a concept is utilized for controlling a conventional car in a hoistway it still would only require four actuators using the same novel rail shape for active control.

In still further accord with the present invention, the actuators may be arranged so as to counteract rotational forces acting on a car about one or more axes in a horizontal plane. Such axes may but need not be defined for purposes of control as orthogonal axes in such a horizontal plane and which may be parallel to the hoistway walls. If such a concept is implemented (which may but need not be in conjunction with control of horizontal translations and vertical rotations) it may, without limitation, use only eight actuators using a novel, plural bladed rail shape for active control.

In accordance still further with the present invention, the actuators may be of the electromagnetic type.

In further accord with the present invention, the actuators may be electromechanical, e.g., solenoid actuated wheels.

In further accord with the present invention, an embodiment utilizes four electromagnetic actuators each operating along an axis which is disposed for imparting forces at an angle of forty-five degrees to a hoistway wall, e.g., opposite hoistway-railed walls. Of course, other orientations may be used.

The present invention teaches, among other things, that for a car guided by rails mounted on hoistway walls, that Ando's twelve electromagnets for controlling horizontal translations of an elevator car can be replaced by a lesser number of actuators. According to an embodiment of the present invention, four actuators are sufficient for controlling such translational forces in the horizontal plane. Moreover, as a further teaching, the same four actuators may be used to control rotational forces about vertical. Although conventional-style rails may be used, a new, plural bladed rail configuration may be advantageously applied in an active system and four actuators may be well disposed with respect thereto for controlling translational forces in the horizontal plane. Moreover, as a further teaching, the same four actuators may be used to control rotational forces about vertical.

These approaches have the added advantage of greatly simplifying the design. Moreover, there is then no need to use Ando's cable which may be subject to out-of-straightness forces due to many factors such as building sway, expansion and contraction due to temperature changes, vibrations due to air currents in the hoistway and other causes. Such a construct can be replaced, according to an embodiment of the present invention by accelerometers used to provide signals which can be indicative of position in a closed loop control system.

Although we teach that a position control system based on an accelerometer output is a superior approach, we also recognize that drift is associated with accelerometers which we leach may be corrected, preferably based on a slow regulating loop to control the average car position with respect to a fixed referent.

Thus, in further accord with the present invention, a preferred embodiment of the present invention comprises a relatively fast, simple, analog control loop responsive to accelerometers with one or more, relatively slower, but more accurate, digital control loops responsive to position or acceleration sensors or to both.

As previously suggested, at least for pendulum cars, the passive restraints employed by Shigeta et al and Luinstra et al are not as effective as the present invention in that they do not actively counteract the undesirable translational forces to which the car is subjected and thus do not provide as smooth a ride for the passenger as that provided by the present invention. Furthermore, they do not actively counteract the undesirable rotational forces to which the car is subjected and thus similarly fail to provide as smooth a ride for the passenger as that provided by the present invention. And certainly they do not even consider restraints or active countermeasures of any kind with respect to rotational axes other than vertical, as taught herein.

These and other objects, features and advantages of the present invention will become more apparent in light of the following detailed description of a best mode embodiment thereof, as illustrated in the accompanying drawings.

BRIEF DESCRIPTION OF THE DRAWINGS

FIG. 41 is a plot of a biasing technique for controlling a pair of opposite electromagnets wherein, for example, the force command for the righthand active guide of FIG. 40 is biased in a positive direction and the force command for the lefthand guide is biased in a negative direction to provide a composite response that avoids abrupt switching between the pair;

FIGS. 42, 42A and 42B are a more detailed illustration of the discrete signal processor of FIG. 40;

FIGS. 43, 43A and 43B are a control scheme for a pair of active guides such as are shown in FIG. 40 including control of both the small actuators and the large actuators and including a steering arrangement for the large actuators;

FIG. 44 is an illustration of some of the parameters illustrated in the control scheme of FIG. 43;

BEST MODE OF CARRYING OUT THE INVENTION

Figure 1:
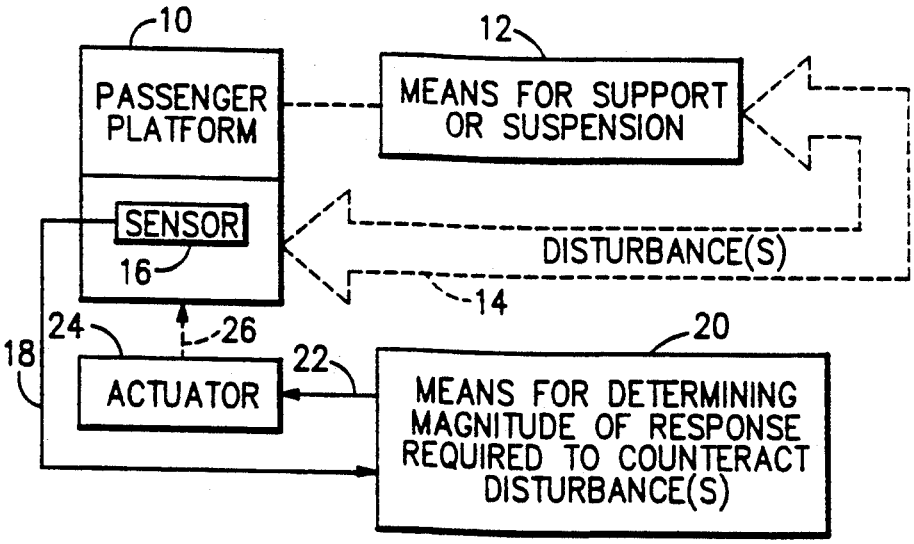
FIG. 1 is a block diagram of an active control system for an elevator car according to the present invention.

In FIG. 1, a passenger platform 10 for an elevator car is suspended or supported by means 12. A car may be suspended by a cable laid over a rotating sheave or a car slidably supported on platform mounted on a hydraulically operated piston. In both cases, the elevator car is moved up and down in an elevator hoistway (not shown in FIG. 1) guided by means such as vertical rails (not shown) attached to the hoistway walls.

According to the present invention, one or more disturbances 14 (such as an air current in the hoistway acting on the car, a bumpy ride disturbance transmitted to the car as a result of an out-of-straightness condition in a section of rail, etc.) may be sensed by a sensor 16 disposed in or on the car or platform 10. The sensor 16 typically senses an effect of the disturbance 14 for providing a signal having a magnitude indicative of the magnitude of the effect on a line 18. Means 20 is responsive to the signal provided on line 18 for determining the magnitude of the response required to counteract the sensed effect of the disturbance and for providing a signal on a line 22 for commanding an actuator 24 to actuate the platform 10 as indicated by an actuation signal on a line 26. The actuator 24 may be disposed, without limitation, between the car and the hoistway for imparting forces therebetween in response to the control signal on line 22.

A plurality of sensors similar to sensor 14 may be disposed to be responsive to one or more selected parameters indicative of translational and rotational movements of the car which cause it to deviate from staying perfectly centered on an imaginary vertical line through the center of the hoistway. Such sensors may be responsive to any one or any number of selected parameters such as the position of the car with respect to the hoistway, the translational accelerations experienced by the car, etc. According to a preferred embodiment of the present invention, acceleration is sensed. Such sensors may provide one or more sensed signals to the means 20 or another similar means in order to complete a closed loop for purposes of automatic feedback control, according to the present invention.

As suggested above, one way to view an embodiment of the invention is to think of the control system as causing the elevator car's vertical centerline to remain coincident with an imaginary reference line up the center of the hoistway, without the suspended car's centerline departing from the hoistway reference centerline or without the car rotating about the coincident centerlines.

Figure 2:
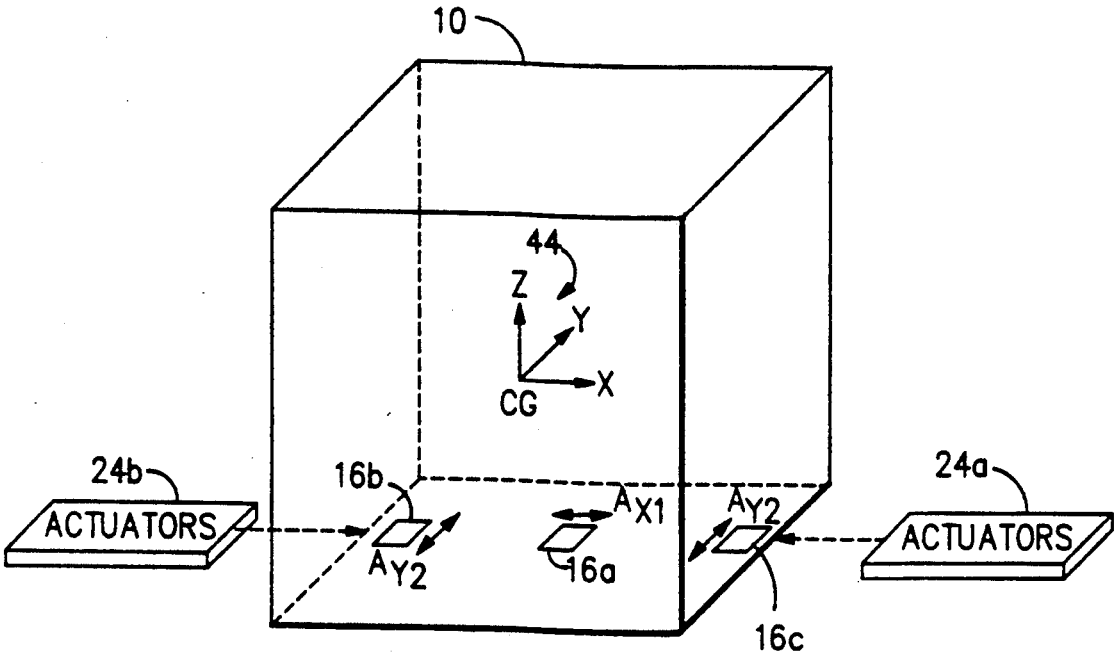
FIG. 2 is an illustration of an elevator car, with a coordinate system shown.

FIG. 2 illustrates car mounted accelerometers 16*a*, 16*b*, 16*c* which together serve as an example of a sensor arrangement that may be used to sense horizontal accelerations manifesting small horizontal translations causing deviations of the car's centerline from the hoistway's centerline and, without necessarily limiting the foregoing, by further sensing accelerations manifesting small rotations of the car about the hoistway centerline. Selective use of one or more groups of actuators, e.g., actuator groups 24*a*, 24*b*, permits the exertion of forces to maintain the desired coincidence of the car and hoistway centerlines and, if desired, with no rotation about vertical. Although two groups of actuators are shown near the bottom of the car, it should be understood that such are shown to indicate actuators acting from any position or in any grouping, i.e., other groupings at other positions are encompassed by the present invention. The fact that the actuators are shown detached from the platform in no way excludes actuators attached to the platform.

Figure 3:
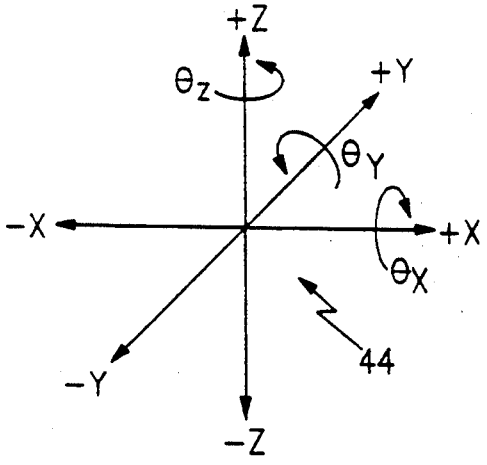
FIG. 3 shows the coordinate system of FIG. 2 in more detail.

An arbitrary three dimensional coordinate system illustration 44 in FIG. 2 has its x-z plane in the paper and should be thought of as having its origin in the center of gravity of the car 10 and having its minus y-axis pointing up perpendicular to the paper toward the reader. The coordinate system 44 of FIG. 2 is illustrated in more detail in FIG. 3. There, it will be observed that in addition to rotations about the vertical z-axis, there may be rotations about the x and y-axes which may be controlled, if desired. Although such is possible, at least in some cases, the present invention only addresses rotations about vertical.

It will be further observed that the accelerometers cannot be positioned at the center of gravity as would be desired. The floor of the passenger compartment is illustrated here without limitation as an acceptable compromise. It will be observed still further from the locations of the accelerometers that translational accelerations along the x-axis can be sensed by accelerometer 16*a* while those along the y-axis can be sensed by accelerometers 16*b*, 16*c*. A miscomparison of the outputs of the two y-sensitive accelerometers will indicate a rotation about the z-axis. A clockwise or counterclockwise rotation will be indicated depending upon which y-accelerometer 16*b* or 16*c* provides the larger magnitude sensed signal. The magnitude of the difference is indicative of the magnitude of the angle of rotation from a reference position.

Although guide rails are not illustrated, such would typically be situated oppositely on two of the four hoistway walls. Such may, for a car example, serve as ferromagnetic masses for use by the actuators 24*a*, 24*b* should the actuator be of the electromagnetic type. In that case, the actuators can be attached near the bottom of the platform 10 for producing magnetic flux for interaction across air gaps with the rails. Or, electromechanical, i.e., contact-type active actuators, to be disclosed below, can be employed. Conventional, passive-type wheel guides can be used at opposite sides at the top of the car to lend additional stability without adding the need for additional active control systems as required by Ando, for example.

In a supported car example using a horizontally sliding platform for support, for example as shown in U.S. Pat. No. 4,660,682 to Luinstra et al, but mounted on a hydraulic piston or within a suspended car frame (as shown by Luinstra et al), electromagnetic, contactless-type actuators 24*a*, 24*b* can be attached to the underside of the sliding platform with suitable ferromagnetic reaction plates erected under the sliding platform on a nonsliding horizontal platform mounted on the top of the piston or, for a supported car, on the floor of the car frame, for providing a path for magnetic flux provided by the actuators.

It should be understood from the foregoing that an embodiment of the present invention may be utilized for increasing ride comfort in an elevator car.

For the car embodiment to be disclosed in more detail below, FIGS. 4–7 and FIGS. 9–13 show various embodiments of a novel, plural-bladed rail configuration, in each case according to the present invention, for use with active control systems, which plural-bladed rails are all distinguished from the prior art single-bladed rail, shown in FIG. 8, used in at least one prior art active system. (See U.S. Pat. No. 4,754,849 to Ando).

In FIGS. 4–7 and FIGS. 9–13, more than one "blade" is used in each case to interface with two or more corresponding actuators. In FIG. 8, in contrast, a single blade 40 is used by all three actuators 42, 44, 46. It should be understood that for all of the plural-bladed rails shown below, the associated actuators may be disposed differently than in the exact manner illustrated.

Figure 4:
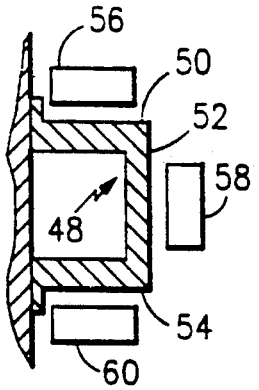
FIGS. 4–7 show various active rail configurations, according to the present invention.

In FIG. 4, a rectangular shape rail 48 has three blades 50, 52, 54 for serving as ferromagnetic paths or masses for three separate electromagnetic actuators 56, 58, 60 respectively. As an example of how an associated actuator could be disposed differently than illustrated, the actuator 58 could be positioned between the blade 52 and the hoistway wall instead, to save space and make the arrangement more compact.

Figure 5:
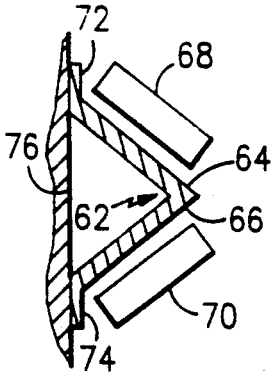

In FIG. 5, a two-bladed rail 62 is shown having a V-shape comprising a blade 64 and a blade 66. A triangle-shaped configuration was previously disclosed for a passive system by Charles R. Otis in U.S. Pat. No. 134,698. However, according to the present invention, plural blades are used in an active system, e.g., the blade 64 serves as a ferromagnetic mass for electromagnetic actuator 68 while blade 66 serves a similar function for actuator 70. It should be understood that the rail 62 may have footings 72, 74 for easily attaching the rail to a hoistway wall 76. Or, the rail 62 may be formed in a full triangular cross-section without footings (not shown). Similarly, referring back to FIG. 4, the three-bladed embodiment may comprise a four-blade box-shaped rail without footings. As another example of how an associated actuator could be disposed differently than illustrated, the actuator 70 could be positioned opposite actuator 68, on the other side of blade 64 and blade 66 could be used as an engagement projection for a safety brake (not shown).

Figure 6:
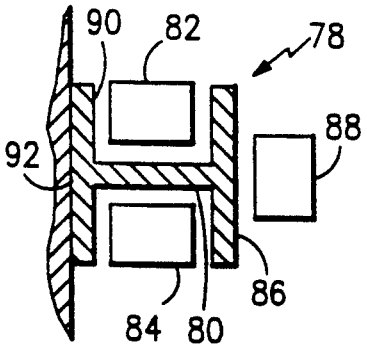

In FIG. 6, an I-beam 78 approach is used. A blade So is used by a pair of opposed electromagnetic actuators 82, 84 while a second blade 86 is used by a third actuator 88. A third blade 90 is not used as a ferromagnetic mass or path by any actuator but may be used to attach the other two blades to a hoistway wall 92.

Figure 7:
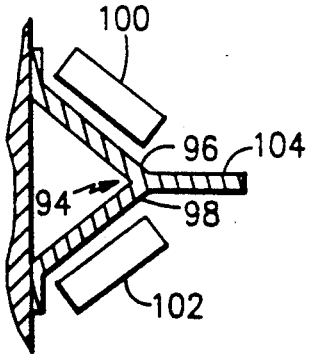
Figure 8:
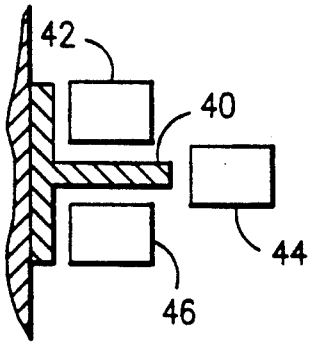
FIG.8 PRIOR ART
FIG. 8 shows a prior art active rail configuration.

FIG. 7 illustrates a variation of the two-bladed V-shaped rail 62 of FIG. 5. Rail 94 comprises a pair of blades 96, 98 for interfacing with respective actuators 100, 102. The rail also includes a projecting blade 104 which may be used as a convenient handle, upon which to engage a safety brake (not shown).

Figure 9:
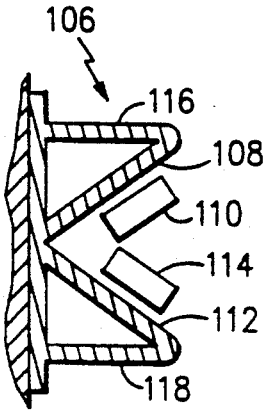
FIGS. 9–13 show various active rail configurations, according to the present invention.

FIG. 9 shows an inverted V-shaped rail 106 having a blade 108 for interacting with an electromagnetic coil 110 and a blade 112 for a coil 114. Blades 116, 118 provide structural strength.

Figure 10:
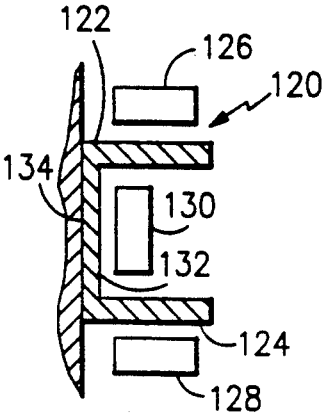

FIG. 10 shows a C-shaped rail 120 having a blade 122 and a blade 124 for providing a ferromagnetic path for coils 126, 128, respectively. A coil 130 uses a blade 132 as its ferromagnetic mass. Blade 132 may also be used to attach rail 120 to a hoistway wall 134.

Figure 11:
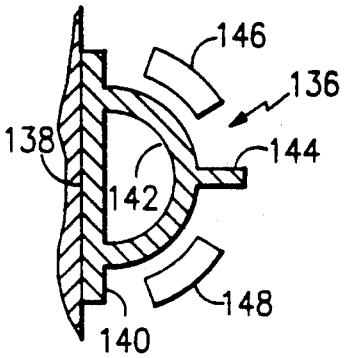

FIG. 11 illustrates a rail 136 mounted on a hoistway wall using a facing pedestal 140. The rail 136 comprises a curved section 142 which, in effect, comprises two "blades", one on either side of a projecting blade 144 for safety brake purposes. One side of the curved section is used for interacting with a coil 146 while the other is used for interacting with a coil 148.

Figure 12:
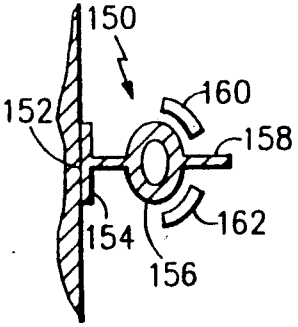

FIG. 12 is an illustration of a rail 150 attached to hoistway wall 152 by means of a footing 154. The active part of the rail 150 comprises a circular rail 156 which in effect comprises two half-circles on either side of a projection 158. Coils 160, 162 used the respective halves of the circle 156 as ferromagnetic masses. Thus, rail 150 is, in effect, a two-bladed rail.

Figure 13:
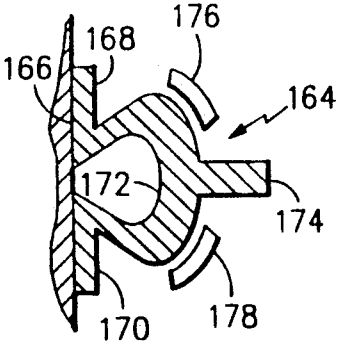

FIG. 13 is an illustration of a rail 164 mounted on a hoistway wall 166 by means of footings 168, 170. A curved section 172 is, in effect, split into two sections on either side of a projection 174. Each section is utilized by an actuator, i.e., actuator 176, 178 respectively. The rail 164 is similar in concept to rail 136 FIG. 11 except it has an "omega" shape rather than a "D" shape.

The rail 94 in FIG. 7 is the preferred embodiment for enabling the utilization of a minimum number of electromagnets, i.e., four, as shown below in connection with stabilization in the horizontal plane or only eight if three axes of rotation are controlled.

Figure 14:
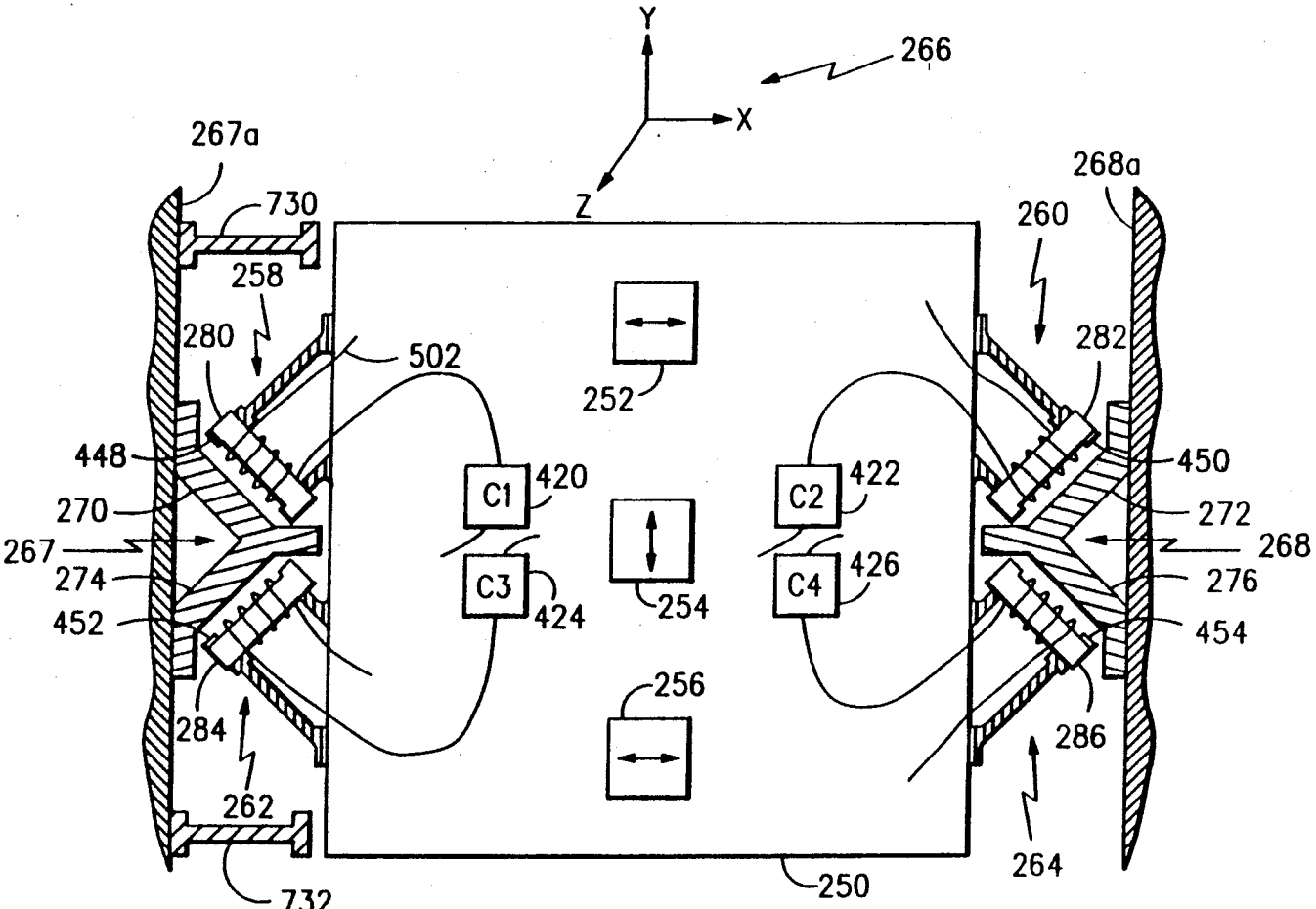
FIG. 14 is an illustration of an elevator car platform in plan view having an active control using "V" or triangular shaped rails, according to the present invention.

Referring now to FIG. 14, the bottom of a suspended or supported car 250 is presented in a plan view which shows the car at rest. For descriptive purposes and not by way of limitation, if one assumes a rectangular or, for even greater simplicity, a square layout for the passenger platform or car floor, one can visualize a pair of reaction planes perpendicular to the car 250 floor which intersect one another along a vertical car centerline which perpendicularly intersects the center of the square. The reaction planes may or may not intersect the floor along the floor's diagonals.

One way to view the embodiment of the invention is to think of the control system as causing the elevator car's centerline to remain coincident with an imaginary reference line up the center of the hoistway without the suspended or supported car rotating about the coincident car and hoistway centerlines.

It does this by the use of car-mounted accelerometers 252, 254, 256 which together are used to sense accelerations manifesting small translational deviations of the car's centerline from the hoistway's centerline and by further sensing accelerations manifesting small rotations of the car about the hoistway centerline and by the selective use of actuators 258, 260, 262, 264 exerting forces perpendicular to the reaction planes to maintain the centerlines' desired coincidence with no rotation. A three dimensional coordinate system illustration 266 in FIG. 14 has its x-y plane in the paper and should be thought of as having its origin in the center of the square 250 and having its z-axis pointing up perpendicular to the paper toward the reader. It will be observed from the locations of the accelerometers that translational accelerations along the y-axis can be sensed by accelerometer 254 while those along the x-axis can be sensed by either accelerometer 252 or 256. A miscomparison of the outputs of the two x-sensitive accelerometers will indicate a rotation about the z-axis. A clockwise or counterclockwise rotation will be indicated depending upon which x-accelerometer 252 or 256 provides the larger magnitude sensed signal. I.e., the magnitude and sign of the miscomparison is indicative of the magnitude and direction of the angle of rotation.

V-shaped rails 267, 268, similar to the rail pictured in FIGS. 5 and 7, or similar, such as that of C. R. Otis, affixed to opposite hoistway walls 267*a*, 268*a* provide ferromagnetic reaction plates 270, 272, 274, 276. Four electromagnet cores 280, 282, 284, 286 with associated coils may be attached to the sides, near the bottom, of a suspended or supported platform so that each faces one of the reaction plates. Attractive forces generated by the control system by means of the four electromagnet core-coils are exerted in such a way as to separate or bring closer the core-coils from their associated reaction plates. The positioning of the core-coils with respect to the reaction planes can of course vary, as with the car example, except in this case most especially according to the selected rail shape.

Figure 15:
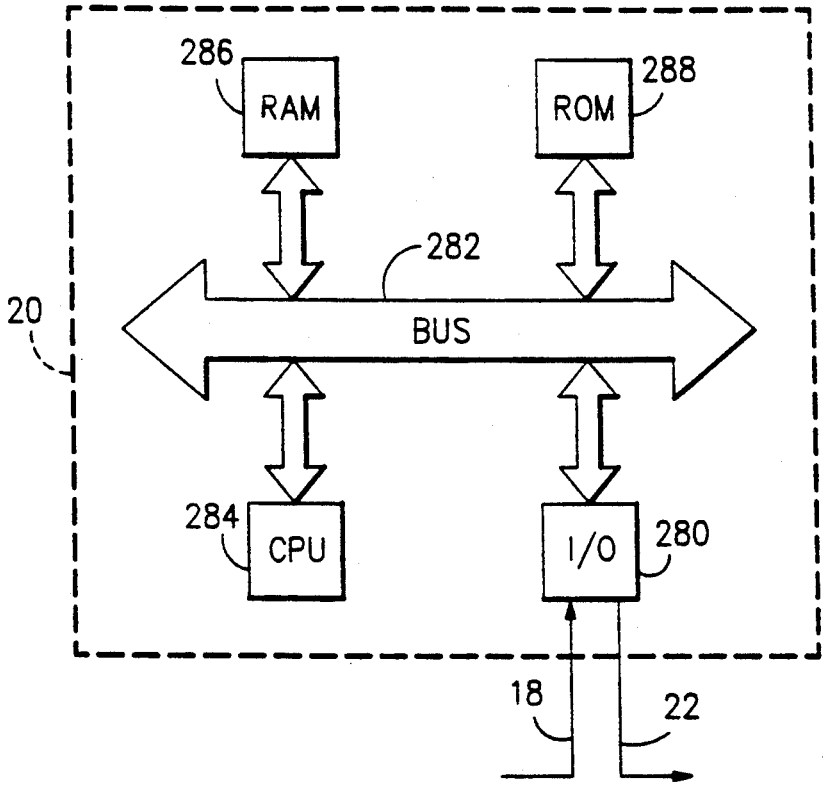
FIG. 15 is an illustration of a signal processor which may be used as the means shown in FIG. 1 for determining the magnitude of the response required to counteract disturbances.

Turning now to FIG. 15, the means 20 of FIG. 1 is illustrated in a digital signal processor embodiment which may comprise an Input/Output (I/O) device 280 which may include an Analog-to-Digital (A/D) converter (not shown) responsive to an analog signal provided by sensor 16, which may be accelerometers 252, 254, 256 shown in FIG. 14, or any sensed parameter indicative of the effect(s) of the disturbance(s) 14. The I/O device 280 may further comprise a Digital-to-Analog (D/A) converter (not shown) for providing force command signals on line 22 to an analog actuator 24 which may instead comprise the actuators 258, 260, 262, 264 of FIG. 14, or any other suitable actuators. Also within the control 20 of FIG. 15 is a control, data and address bus 282 interconnecting a Central Processing Unit (CPU) 284, a Random Access Memory (RAM) 286 and a Read Only Memory (ROM) 288. The CPU executes a step-by-step program resident in the ROM, stores input signals having magnitudes indicative of the value of the sensed parameter as manifested on the line 18, signals having magnitudes representing the results of intermediate calculations and output signals having magnitudes indicative of the value of the parameter to be controlled as manifested in the output signal on line 22.

Figure 26:
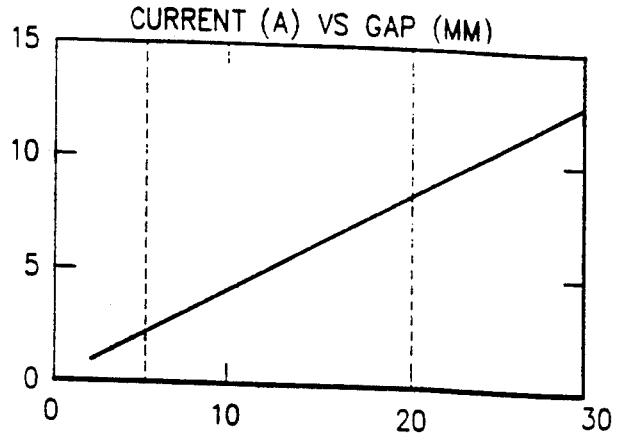
FIG. 26 is a plot of coil current vs. air gap.
Figure 48:
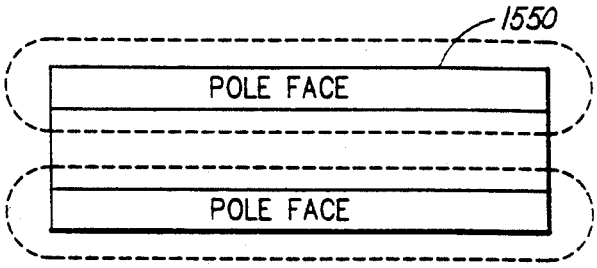
FIG. 48 is an illustration of a relatively long electromagnet core for orientation in a vertical manner, according to the present invention.

The cores 280, 282, 284, 286 of FIG. 15 may be shaped as shown in FIG. 48 and may have dimensions as described in connection with FIG. 50 and may be oriented as shown, with the "C" being horizontal and the long part of the core oriented vertically. Or, the core may be shaped rather stoutly as shown in FIG. 26 herein and be oriented as shown in FIG. 6 of Japanese Kokai 60-36279.

Figure 16:
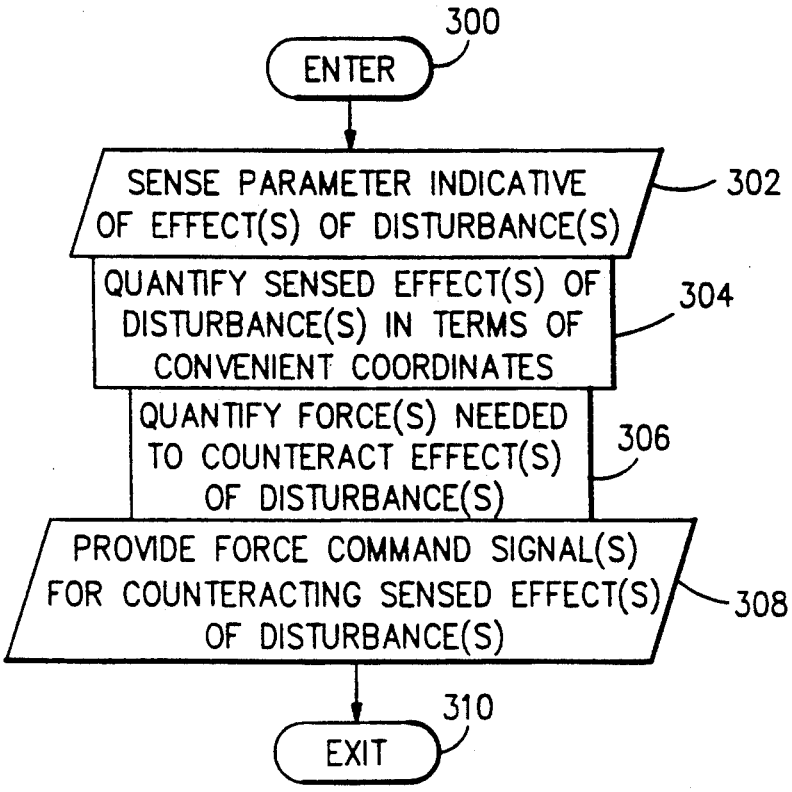
FIG. 16 is an illustration of a series of steps which may be carried out by the processor of FIG. 15 or its equivalent in determining the magnitude of the response required to counteract disturbances.

Returning to the arrangement of the car platform of FIG. 14 and at the same time referring to FIG. 16, a simplified step-by-step program will be explained for execution by the CPU of FIG. 15 in effecting the closed loop control function previously explained in connection with the means 20 of FIG. 1 and the embodiment thereof shown in FIG. 15. After entering at a step 300, an input step 302 is executed in which the magnitude(s) of the signal(s) on line 18 is(are) acquired by the I/O unit 280. For the purposes of FIG. 15, these shall be referred to as signals $A_{x1}$, $A_{x2}$ and $A_y$ provided by accelerometers 252, 256, 254 of FIG. 14 and stored in the RAM 286 of FIG. 15. One or the other of the two x-axis accelerometers 252, 256 can be used in a step 304 to compute the magnitude of a positive or negative $A_x$ signal, or both can be used as a check against one another, used to provide an average, or used in some such similar redundancy technique. (Of course, it should be realized that the steps 302, 304 can be combined into a single sensing step if a rotation sensor is provided along with two translational [x and y] sensors). From a comparison of the two signals provided by accelerometers 252, 256 a computation of $A_\Theta$ may be made in step 304. The magnitude of the signal $A_{73}$ will depend on the degree to which the magnitude of the signals from accelerometers 252, 256 differ. The sign of their summation determines the rotational direction. The values of $A_x$, $A_y$ and $A_\Theta$ are stored temporarily in RAM 286.

A step 306 is next executed in which a computation is made of the forces needed to counteract the effect(s) of the disturbance(s) as manifested in one or more sensed parameter(s) (accelerations preferred). Such may be made based on the known mass of the suspended or supported car or car and the formula $F-ma$ where "F" represents the required counterforce, "m" the mass of the suspended or supported car or car and "a" the value of the sensed acceleration. Thus, $F_x$, $F_y$ and $F_\Theta$ are computed from the signals $A_x$, $A_y$ and $A_\Theta$ that were stored in RAM 286 in step 304. These computed values are provided in the form of force command signals on line 22 as indicated in a step 308. It should be understood that the orientation of the actuators as shown in FIG. 14 is such that a command signal calling for a positive x-direction counterforce will have to be exerted by electromagnets 260, 264 acting in concert, each providing half the required counterforce by each providing a force equal to the commanded x-direction force multiplied by cos(45°). Similar divisions of counterforces are made for the y-direction and for rotations as well. A set of formulae that will cover all the possibilities follows (in the following equations, the subscripts 1, 2, 3, 4 correspond, respectively, to electromagnetic actuators 258, 260, 262, 264 of FIG. 14):

$$F_{x+}:\ F_2 = (KCS)(F_{x+}) \qquad F_{x-}:\ F_1 = (KCS)(F_{x-})$$
$$F_4 = (KCS)(F_{x+}) \qquad F_3 = (KCS)(F_{x-})$$

$$F_{y+}:\ F_1 = (KCS)(F_{y+}) \qquad F_{y-}:\ F_3 = (KCS)(F_{y-})$$
$$F_2 = (KCS)(F_{y+}) \qquad F_4 = (KCS)(F_{y-})$$

$$F_{\theta+}:\ F_1 = (KCS)(F_{\theta+}) \qquad F_{\theta-}:\ F_2 = (KCS)(F_{\theta-})$$
$$F_4 = (KCS)(F_{\theta+}) \qquad F_3 = (KCS)(F_{\theta-})$$

where

F=force, and

KCS=cos(45°)=sin(45°)=0.707.

After making the necessary computations and providing the required counterforce command signals the program may then be exited in a step 310. However, it is preferable to add additional steps in order to superimpose a system for insuring against imperfectly levelled accelerometers and also against a changing offset in the accelerometers. For purposes of embodiments of the present invention, accelerometers have two major errors: (i) offset drift and (ii) pickup of unwanted gravity components due to not being perfectly level; also present, but not as significant, are (iii) linearity errors. A nonlevel accelerometer will sense accelerations due to gravity in proportion to the sine of the angle it makes with true vertical. Correction for nonlinearity is not usually important in embodiments of this invention but may be corrected for, if desired. Assuming the nonlinearity retains its basic relationship with true linearity as adjusted for changes in offset, such nonlinearity may be corrected at each stage of sensed acceleration by consulting a lookup table which is used to supply a corrective factor. If offset were constant over time it could be corrected for straightforwardly with a constant correction factor. But, since offset can change over time due to temperature, aging, etc., corrections should be made in a dynamic manner. Offset and changing offset, as well as accelerations due to gravity, can be corrected by providing a relatively slower acting feedback control system for controlling the position of the car with respect to the hoistway centerline. This may be done by recognizing that the average lateral acceleration must be zero (or the car would travelling off into space). The slow acting loop offsets the average accelerometer output signal. Averaging may be accomplished, e.g., using an analog low-pass filter or a digital filter.

Figure 17:
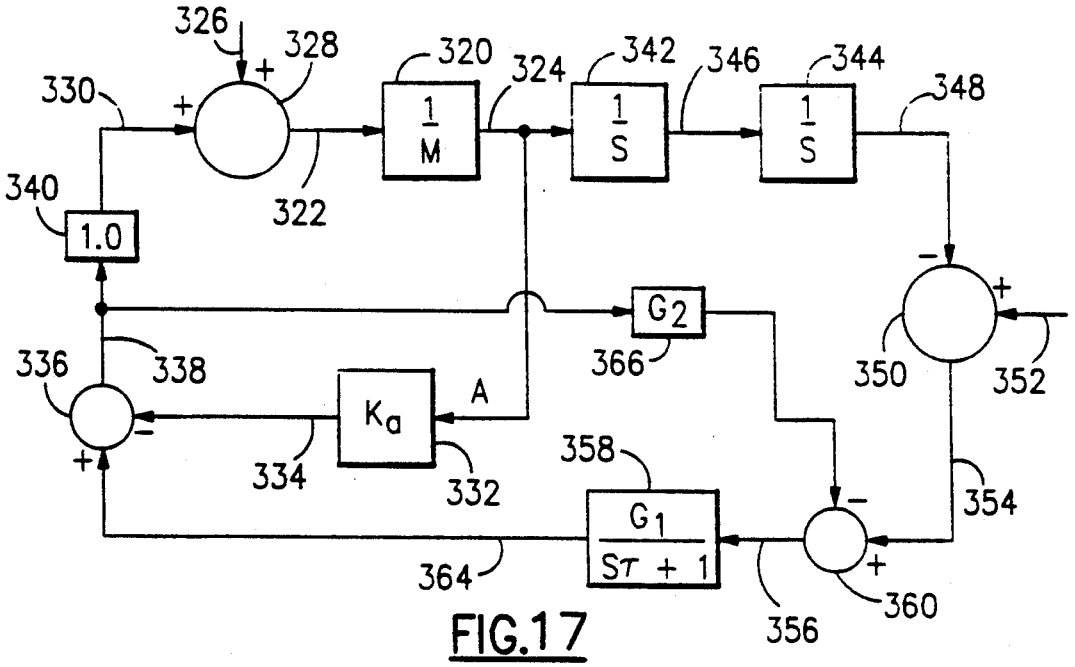
FIG. 17 shows a mathematical abstract of a preferred control scheme for carrying out the active control of FIG. 1.

Thus, if we think of a single axis of control such as the x-axis shown in FIG. 15, the theory of operation of such a system for controlling the car or car with both acceleration and position sensors is shown in FIG. 17. The system in elementary form comprises the car mass as illustrated by a block 320. The car mass is acted upon by a force on a line 322 which causes an acceleration as illustrated by a line 324. A disturbing force is shown schematically as a signal on a line 326 slimmed in a "slimmer" 328 (an abstract way of representing that the disturbing force is physically opposed by the counteracting force) with a counterforce signal on a line 330 provided in proportion ($K_a$) to the acceleration (A) shown on the line 324 as sensed by an accelerometer 332 which provides a sensed acceleration signal on a line 334 to a summer 336. The scale factor ($K_a$) of the accelerometer is (volt/m²/s). (As previously indicated, the acceleration on line 324 is produced by the disturbing force on line 326 interacting with the mass of the suspended or supported car according to the relation F/M as suggested in block 332, where F is the disturbing force and M is the mass of the car. The summer 328 represents the summation of the disturbing force on line 326 and the counterforce on line 330 to provide a net force on a line 322 acting on the mass 320.) The simmer 336 provides a signal on a line 338 to a force generator 340 having a transfer characteristic of 1.0 Newton/volt. The summer 336 serves to collect an inner acceleration loop signal on line 334 with the outer acceleration and position loop signals to be described below prior to introduction on the line 338 into the force generator 340. The inner acceleration loop comprising elements 320, 332, 340 and the associated simmers forms the primary control loop used for "mass augmentation" as defined herein.

The description of FIG. 17 so far covers the theory of the control system previously described in connection with FIGS. 1–16. Secondary control loops may also be added as illustrated in the abstract in FIG. 17.

Shown are two secondary control loops which may be used for nulling offsets in the accelerometer 332 caused, e.g., by misalignment with gravity and due to manufacturing imperfections. The first of these secondary loops corrects on the basis of position offsets. A position transducer that gives car position is represented abstractly by an integrator block 342 and an integrator block 344. The integrator 342 provides a velocity signal on a line 346 to the integrator 344 which in turn provides a position signal on a line 348. The car position signal on line 348 is compared in a shimmer 350 with a reference signal on a line 352. The signal on the line 352 would ordinarily be a fixed DC level scaled to represent, e.g., the x-position (in the car coordinate system 266 of FIG. 14) of a selected referent such as the hoistway centerline (which will be substantially coincident with true vertical, i.e., a line along which the earth's gravity will act). The simmer 350 provides a signal on a line 354 and is provided on a line 356 to a low-pass filter 358 after being summed in a summer 360 with a signal on a line 362. The low-pass filter 358 provides a filtered signal on a line 364 which causes the force on the line 330 to be applied on the line 322 to the car 320 until the position error signal is driven to zero or close to zero.

A second secondary control loop may be introduced if a position signal is not conveniently available or to enhance the stability of the position correction control loop. The position error signal on line 354 may thus be modified in the simmer 360 by being summed with the signal on line 362 which is provided by a gain block 366 which is in turn responsive to the signal on line 338 which is representative of the acceleration sensed in the primary loop.

An extraneous signal on line 338 will appear directly on line 322 if $G_1=0$ and $G_2=0$. Assuming no indicated position error on line 354 and nonzero gains $G_1$ and $G_2$, a disturbance manifested by an acceleration signal on line 334 will appear on line 322 reduced by a dynamic factor $$\frac{S\tau + 1}{S\tau + [1 + (G_1 \cdot G_2)]}.$$

This factor approaches unity at higher frequencies, indicating no effectiveness. At lower frequencies, however, this factor approaches [b $1/(1+G_1{*}G_2)$]. Typically, $G_1{*}G_2$ could be chosen equal to nine (9) to reduce accelerometer offsets by a factor of ten (10).

The position feedback loop offers the advantage of very low error. Without the accelerometer feedback loop 366, 360, 358, 336 and/or practical control elements being present this loop may not be as stable. Assuming gain $G_2=0$, the only way for the position loop to be stable is for the car mass to be acted upon by damping, friction and an inherent spring rate due to pendulousity, acting singly or in concert. One or more of these elements will be present in a practical system. Use of an accelerometer loop by making $G_2$ nonzero can enhance the operation of the position loop.

Figure 18:
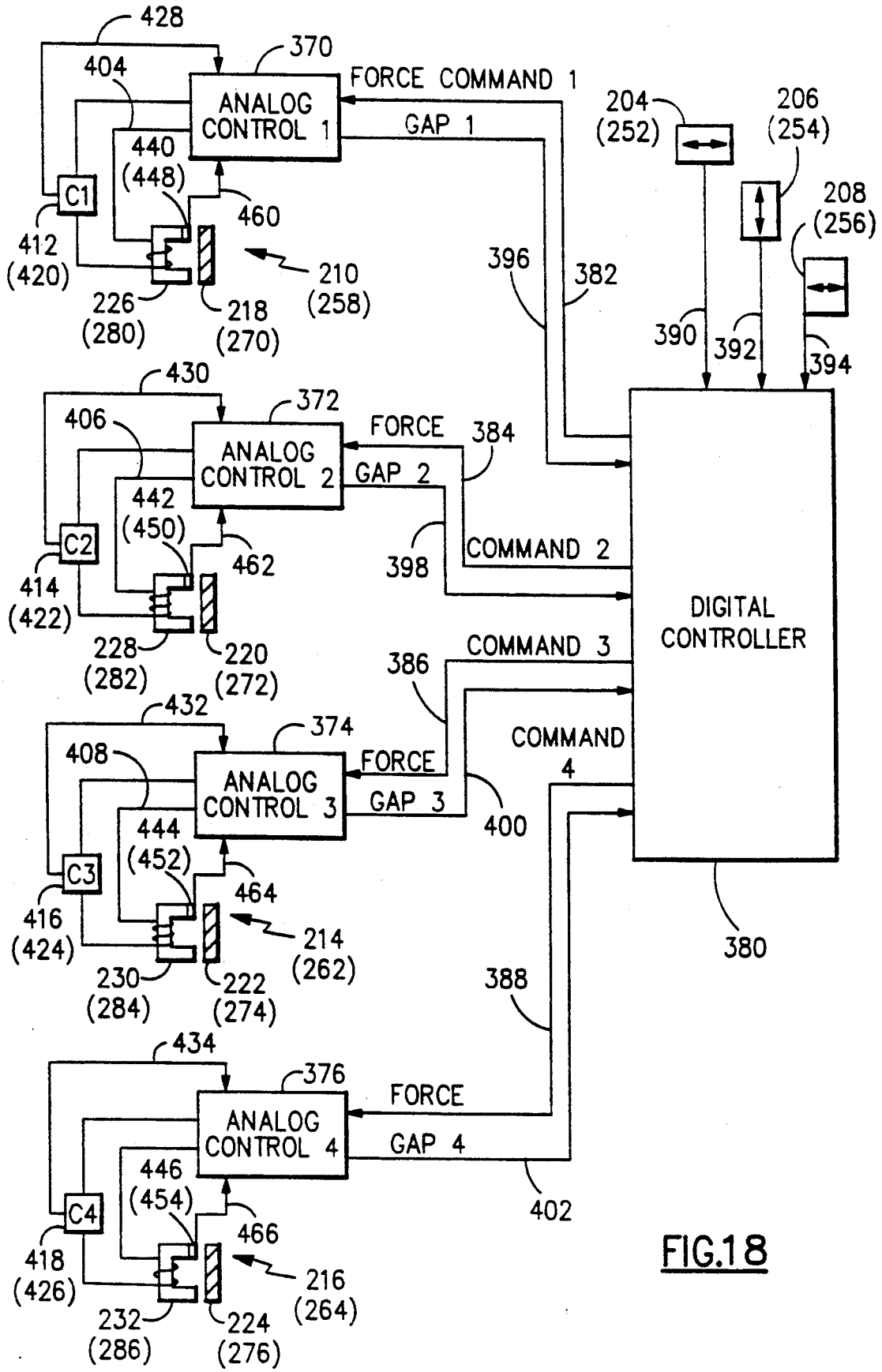
FIG. 18 shows preferred means for carrying out the preferred control scheme of FIG. 17.

The control represented in abstracted form in FIG. 17 may be carried out in numerous different ways, including a wholly digital approach similar to that of FIG. 15, but a preferred approach is shown in FIG. 18.

There, a fast-acting analog loop for quickly counteracting disturbing forces is combined with a slower acting but more accurate digital loop for compensating for gravity components and drifts in the accelerometers. A plurality of such fast-acting analog loops may be embodied in analog controls 370, 372, 374, 376 as shown, one for each of the respective actuators 258, 260, 262, 264, of FIG. 15. With proper interfacing (not shown), a single digital controller 380 can handle the signals to be described to and from all four analog controls. Each analog control responds to a force command signal on lines 382, 384, 386, 388 from the digital controller 380. The force command signals will have different magnitudes depending on the translational and rotational forces to be counteracted. The digital controller 380 is in turn responsive to acceleration signals on lines 390, 392, 394 from the accelerometers 252, 254, 256 (the accelerometers being from FIG. 14), and to position signals on lines 396, 398, 400, 402 indicative of the size of the air gaps between the coil-cores 280, 282, 284, 286 and their respective plates 270, 272, 274, 276.

In response to the force command signals on lines 382, 384, 386, 388, the analog controls 370, 372, 374, 376 provide actuation signals on lines 404, 406, 408, 410 to the coils of the coil-cores 280, 282, 284, 286 for causing more or less attractive forces between the respective core-coils 289, 282, 284, 286 and their associated reaction plates. The return current through the coils is monitored by current monitoring devices 420, 422, 424, 426 which provide current signals on lines 428, 430, 432, 434 to the respective analog controls 370, 372, 374, 376. The current sensors may be, e.g., Bell IHA-150 with multiple looping of the "through" lead.

A plurality of sensors 448, 450, 452, which may be Hall cells (e.g., of the type Bell GH-600), are respectively associated with each core 280, 282, 284, 286, for the purpose of providing an indication of the flux density or magnetic induction (volt-sec/$m^2$) in the gap, i.e., between the faces of the cores and the associated plates or, otherwise stated, the flux density in the air gaps therebetween. The sensors 448, 450, 452 provide sensed signals on lines 460, 462, 464, 466, respectively, to the analog controls 370, 372, 374, 376.

Figure 19:
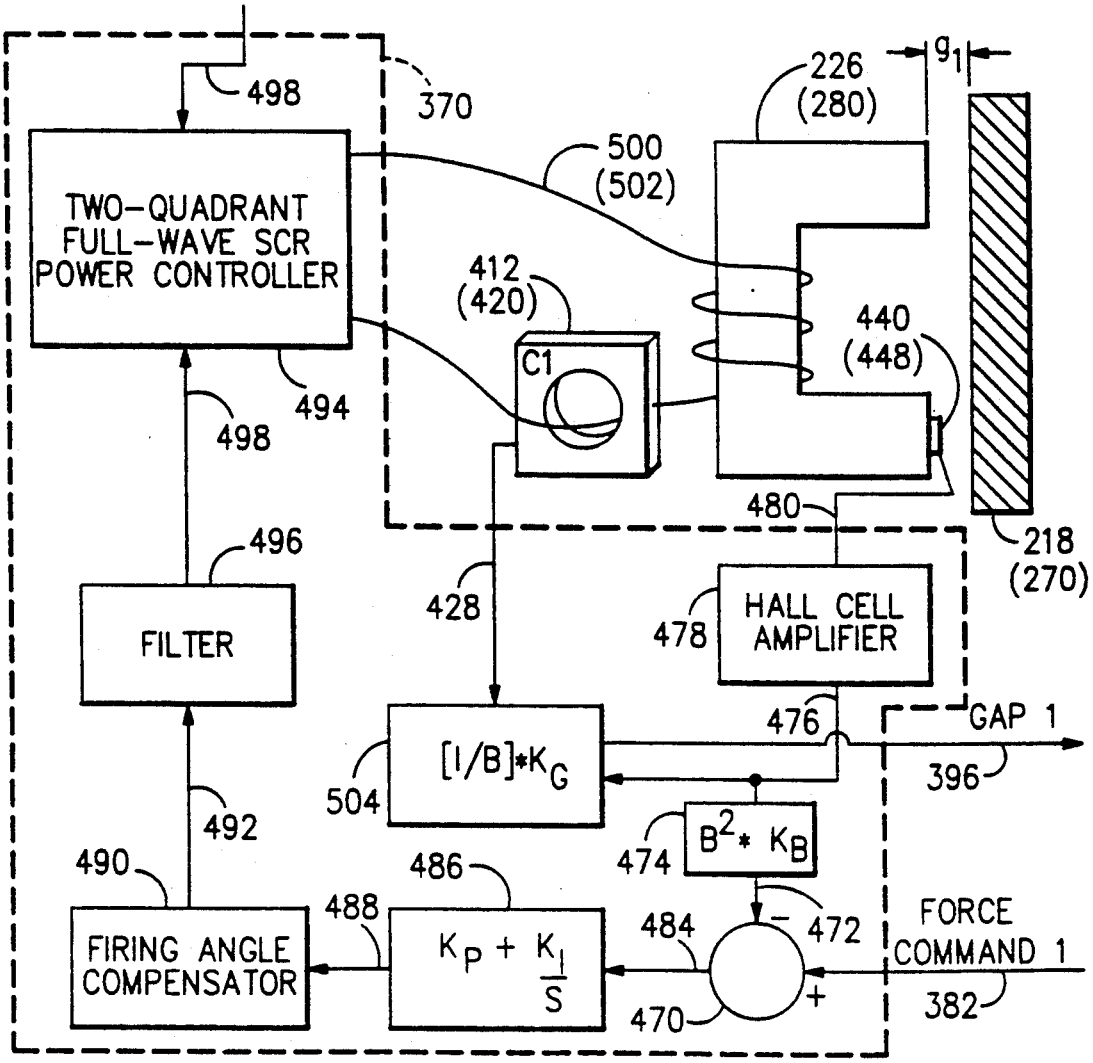
FIG. 19 shows an analog control of FIG. 18 in more detail.

Referring now to FIG. 19, the analog control 370 among the plurality of analog controls 370, 372, 374, 376 of FIG. 19, is shown in greater detail. The other analog controls 372, 374, 376 may be the same or similar. The force command signal on line 382 from the digital controller 380 of FIG. 19 is provided to a summer 470 where it is slimmed with a signal on a line 472 from a multiplier 474 configured as a squaring circuit (to linearize control) having a gain selected dimensionally to be equivalent to magnetization (amp/meter) and properly scaled to convert a signal on a line 476 indicative of flux density to one indicative of force. The flux density signal on line 476 is provided by a Hall cell amplifier 478 which is used to boost the level of the signal on a line 480 from the Hall cell 448.

The summer 470 provides a force error signal on a line 484 to a proportional-integral (P-I) amplifier 486 which provides a P-I amplified signal on a line 488 to a firing angle compensator 490. Compensator 490 provides a firing angle signal on a line 492 which controls the firing angle of a plurality of SCRs in a controller 494 after being filtered by a filter 496 which in turn provides a filtered firing angle signal on a line 498 to the controller 494 which is more fully described as a single phase, two-quadrant, full-wave, SCR power converter. This type of converter is preferred over one-quadrant and half-wave converters. The least preferred combination would be a one-quadrant, half-wave. There would be a slight cost savings in using these non-preferred approaches but the dynamic performance would be significantly degraded. An inexpensive, one-quadrant system is possible using a DC rectifier and a transistor PWM chopper. The highest performance approach would be a full-wave, two-quadrant, three phase converter but this is not the preferred approach because of cost considerations. The two-quadrant, full wave converter 494 of FIG. 20 may be made up, for example, of a pair of Powerex CD4A1240 dual SCRs and a commercial firing board such as a Phasetronics PTR1209. The power controller 252 is powered with 120 VAC on a line 498 as is the firing board and provides the proper level of current on line 500 or 502 in response to the filtered firing angle signal on line 498.

The signal on the line 428 from the current sensor 412 or 420 is provided to an analog multiplier/divider 504 (such as an Analog Devices AD534) which is also responsive to the flux density signal on line 476 for dividing the magnitude of the current signal on line 428 by the magnitude of the flux density signal on line 476 and multiplying the result by a proportionality factor in order to provide the signal on line 396 (back to the digital controller 380 of FIG. 19) indicative of the magnitude of a gap ($g_1$) between the face of the core of the core-coil 280 and the plate 270.

As mentioned previously, the digital controller 380 is responsive to the gap signals on the lines 396, 398, 400, 402, as well as the acceleration signals on lines 390, 392, 394, for carrying out, in conjunction with the analog control of FIG. 19, the control functions of FIG. 17. Instead of generating force signals on the lines 382, 384, 386, 388 in exactly the same manner as previously disclosed in connection with FIGS. 15 and 16, such signals, though generated in a similar manner, are modified by summation with corrective force signals calculated to correct for position imbalances detected by the position sensor 448 and similar sensors 450, 452 associated respectively with the actuators 260, 262, 264 as shown in FIG. 14. (Note: These are the Hall sensors used to find flux density. The signals from the position sensors such as sensor 448 and from current sensor Cl, when processed by the divider circuit 504 give the GAP1 signal on line 396. Similar processing in the other channels yields the GAP2, GAP3 and GAP4 signals on lines 398, 400, 402.) Such corrective force signals may be generated, for example, by first resolving the sensed position signals into components along the axes of the Cartesian coordinate system 266 of FIG. 14 as in the equations which follow, $$P_{x+} = (P_1 + P_3)/(2KCS),\ P_{x-} = (P_2 + P_4)/(2KCS),$$
$$P_{y+} = (P_1 + P_2)/(2KCS),\ P_{y-} = (P_3 + P_4/(2KCS),$$
$$P_{\theta+} = (P_2 + P_3)/2,\ P_{\theta-} = (P_1 + P_4)/2,$$

and then, based on the above, computing or selecting $P_x$, $P_y$, and $P_\Theta$ (which together specify the absolute position of the car), from $P_{x-}$ and $P_{x+}$, $P_{y-}$ and $P_{y+}$, and $P_{\Theta+}$ *l and* $P_{\Theta-}$. $P_x$, for example, may be computed as follows:

$$P_x=(P_{x+}-P_{x-})/2.$$

Or, one can select $P_{x+}$ or $P_{x-}$, depending on which quantity is smaller. (Note: For large gaps, i.e., for large $P_{x+}$ or $P_{x-}$, the value is likely to be inaccurate and may be discarded). The resultant components are used to determine position control force components $F_{px}$, $F_{py}$, $F_{p\Theta}$ as illustrated in FIG. 17 on a single-axis basis ("p" stands for position feedback). $P_x$, for example on line 348, is compared to a reference on line 352 to generate an x-position error signal on line 354. This in turn is passed through a low-pass such as filter 358. This provides an $F_{px}$ signal. For purposes of resolving the required x-counterforce, if a positive force is required, $F_{p1}=F_{p3}=(0.5)(F_{px})/(\cos 45°)$. For a negative force, $F_{p2}=F_{p4}=(0.5)(F_{px})/(\cos 45°)$. This same procedure may be followed for $F_{py}$ and $F_{p\Theta}$ using, of course, the appropriate equations. Thus, the force components $F_{px}$, $F_{py}$ and $F_{p\Theta}$ may be resolved into corrective signals $F_{p1}$, $F_{p2}$, $F_{p3}$, $F_{p4}$, according to the following complete set of equations, $$F_{px+}:\ F_1 = (KCS)(F_{px+}) \quad F_{px-}:\ F_2 = (KCS)(F_{px-})$$
$$F_3 = (KCS)(F_{px+}) \qquad F_4 = (KCS)(F_{px-})$$

$$F_{py+}:\ F_1 = (KCS)(F_{py+}) \quad F_{py-}:\ F_3 = (KCS)(F_{py-})$$
$$F_2 = (KCS)(F_{py+}) \qquad F_4 = (KCS)(F_{py-})$$

$$F_{p\theta+}:\ F_2 = (KCS)(F_{p\theta+}) \quad F_{p\theta-}:\ F_1 = (KCS)(F_{p\theta-})$$
$$F_3 = (KCS)(F_{p\theta+}) \qquad F_4 = (KCS)(F_{p\theta-})$$

where

F=force, and

KCS=cos(45°)=sin(45°)=0.707, which are then summed with the acceleration feedback signals $F_1$, $F_2$, $F_3$, $F_4$ (such as the signal on line 364) generated in the manner previously described in connection with FIGS. 1-19.

It should be realized that a valid position reading will only be available from the flux sensors of the type described unless its associated force actuator is being driven. This means that any processing algorithm must be dependent upon whether or not there are magnet coil actuation currents present.

It should also be realized that the gap signals on lines 396, 398, 400, 402 could be provided by a simple position sensor only.

An additional teaching of our invention is that the electromagnets may be used to control the position of the car at stops, e.g., to bring the suspended or supported car to rest with respect to the frame while on- and off-loading passengers. Of course, the signal processor of FIG. 15, the digital controller 380 of FIG. 18 or an additional signal processor may handle additional control functions such as the starting and stopping of cars and the dispatching of cars. In the case of stopping at a floor, it may receive a sensed signal on line 24 or an algorithmically determined but similar signal indicating the car is vertically at rest and will then provide a signal on line 18 to control the position of the suspended or supported car. For example, if the car platform 250 of FIG. 14 is oriented in the hoistway such that the bottom edge of the car in the Figure represents the car's sill 509 in alignment with a hoistway door sill 510*a* in a hoistway wall 510, then the signal processor 20 of FIG. 15 may be programmed to provide force command signals to actuators 258, 260 in order to provide the attractive forces needed to force the suspended car up against, e.g., stops 530, 532 mounted on the hoistway wall 510 so as to push the car sill 509 into position at rest with respect to, and in close alignment with, the hoistway entrance 510*a* sill after the frame 250 comes to rest.

Figure 22:
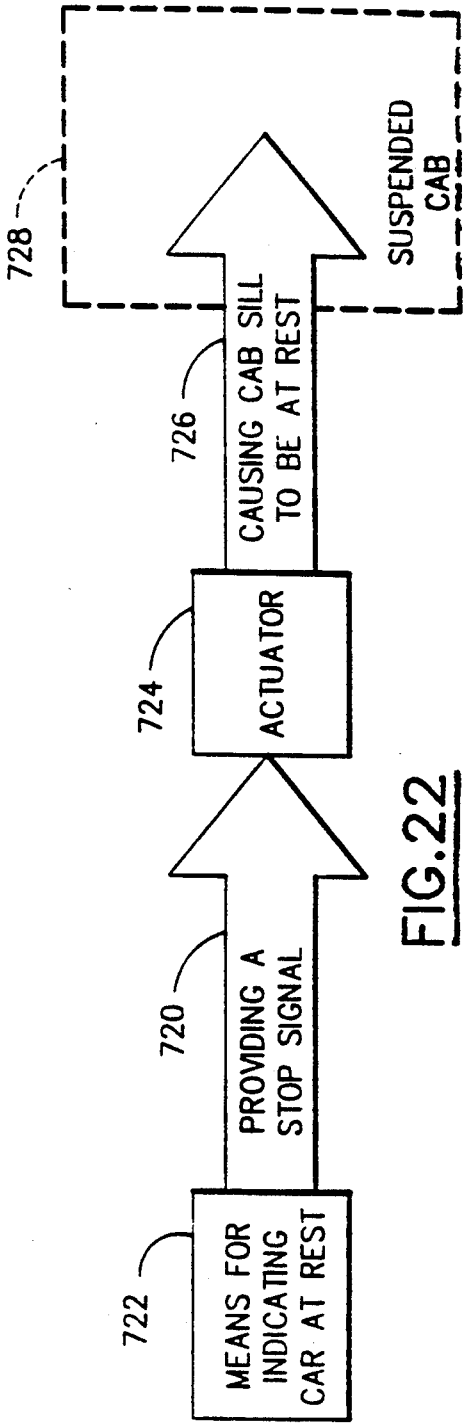
FIG. 22 illustrates steps which may be carried out in using actuators to bring a suspended or supported platform to rest at a sill, according to the present invention.

The method used to accomplish the same is shown in FIG. 22 where a stop signal is provided in a step 520 from means 522 (which may be incorporated in the processor 380 in an additional role of controlling a car or group of cars) for indicating the car frame has come to rest vertically, providing a stop or stop command signal and, in response thereto, an actuator 524 (which may be actuators 258 and 260 or 262 and 264 acting in concert) provides an actuating signal as shown in a step 526 for causing a suspended car 528 (which may be car 250) to come to rest with respect to the hoistway wall such that the car sill is adjacent to the hall sill and motionless with respect thereto.

Figure 21:
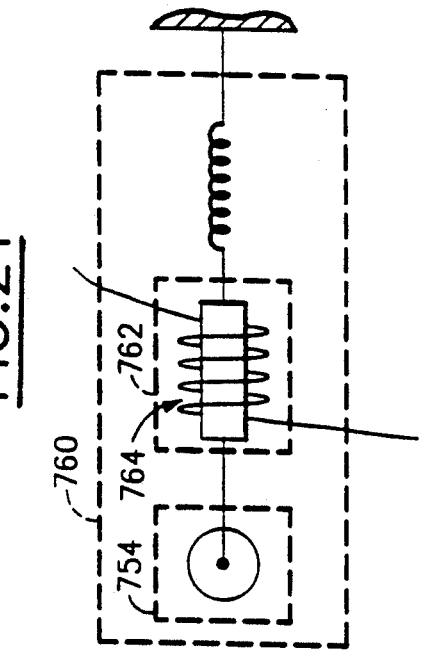
FIG. 21 shows a solenoid actuated wheel for use in an active system such as that of FIG. 20.
Figure 20:
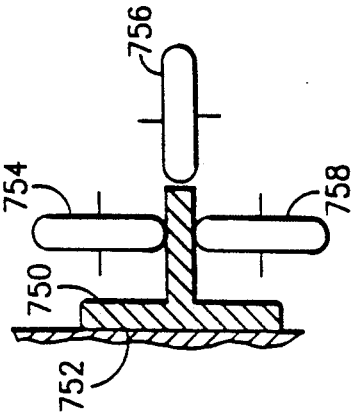
FIG. 20 is an illustration of a three wheel active guide, according to the present invention.

It should be understood that although a disclosed embodiment of the invention utilizes electromagnetic, noncontact type actuators and, in particular, in connection with a suspended or supported car uses electromagnetic actuators such as are shown in FIG. 14 in conjunction with hoistway rails, it is also possible to employ contact-type, active actuators. For example, FIG. 20 shows a standard rail 550 attached to a hoistway wall 552 having three contact-type actuators having wheels 554, 556, 558 in contact therewith for guiding an elevator car. FIG. 21 shows one of the actuators 560 in detail having wheel 554 associated therewith actuated with a solenoid 562 having a coil 564 similar to a coil which would be used in an electromagnet actuator of the previously disclosed, contact-less type. The other wheels 556, 558, would have similar solenoids associated therewith.

Figure 23:
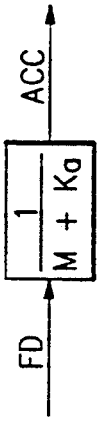
FIG. 23 presents FIG. 18 in simplified form to show the concept of synthesizing platform mass by means of an actuator in a simple manner.

FIG. 23 shows a reduced block diagram of the same concept presented in FIG. 17 above. The reduced model is valid at all but the lowest frequencies.

The FIG. 23 diagram may be expressed in units scaled to as follows:

$$\text{Acceleration of car}=[FD/G][1/(M+Ka)]$$

where

FD is the disturbing force,
M is the mass of the suspended car,
Ka is the counter-mass "added" by the actuator, and
FD/G is the mass equivalent of the disturbing force using the acceleration due to gravity (G) at the earth's surface.

If, in the foregoing equation, we let Ka=0, i.e., we assume the absence of active control, and let M=1000 kg and FD/G=25 kg, then we obtain an acceleration due to the disturbing force (FD) of 25/1000=25 mG. If we now wish to introduce active control, we can assume Ka=9000 kg and we now obtain a tenfold reduction in acceleration due to the disturbance, i.e., 25/(1000+9000)=2.5 mG. We can thus conclude that if we proceed along these lines we will at least have an order of magnitude improvement in ride comfort.

Now, assuming a Ka of 9000 kg is desired, we can assume an acceleration scale factor (ASF) of 100 Volt/G and a force generator scale factor (FGSF) of KA/ASF (the product of ASF and FSGF yields $K_a$) which in this case yields 9000 kg/100 Volt/G=90 kg(force)/Volt or, equivalently, 882 Newton/Volt.

Figure 24:
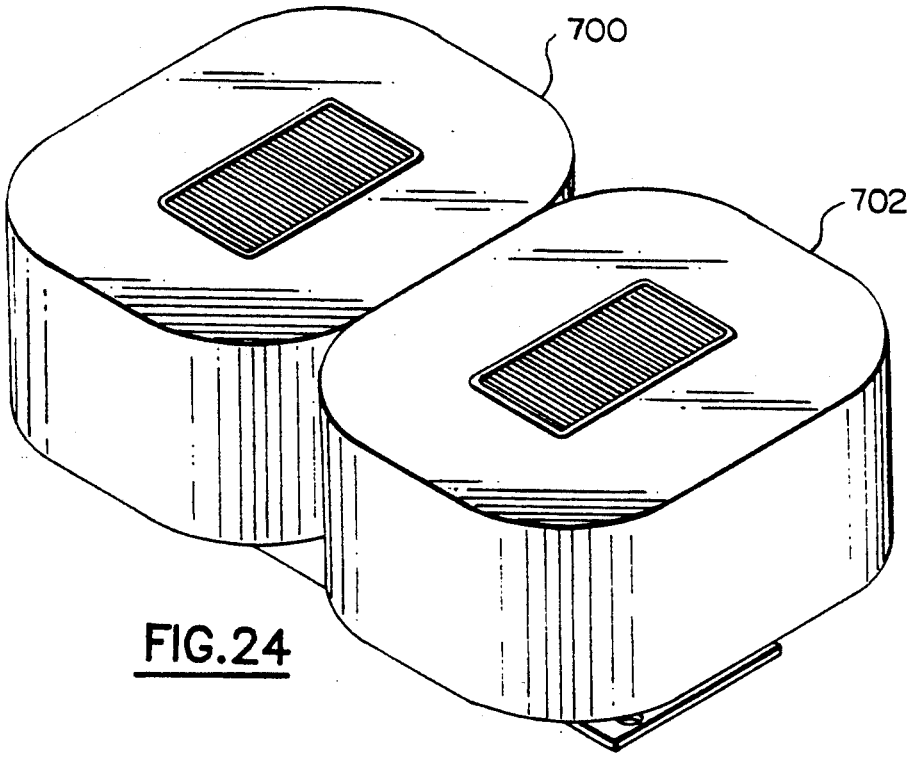
FIG. 24 shows a pair of coils for use with a U-shaped core such as shown in FIG. 25.
Figure 25:
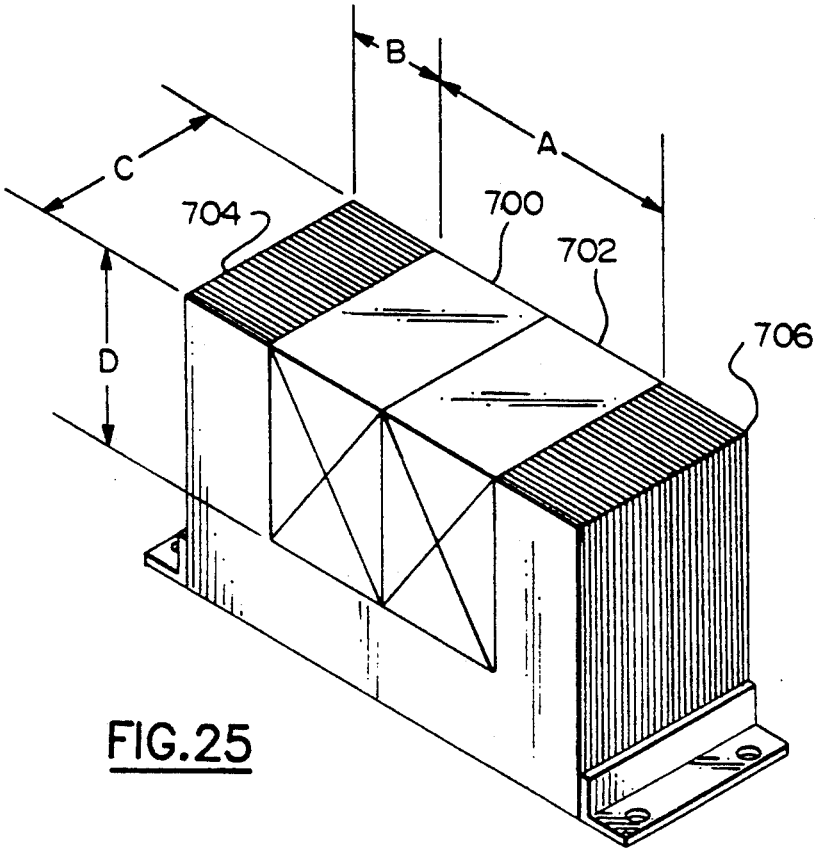
FIG. 25 shows a U-shaped core for use with the coils of FIG. 24.

An electromagnet actuator such as described previously may be constructed in a U-shape as shown in FIGS. 24 and 25. In FIG. 24, double coils 700, 702 are shown which fit over legs 704, 706, respectively, as shown in FIG. 25. The coils 700, 702 constitute a continuous winding and are shown in isometric section in FIG. 24. Coil 700 and coil 702 may each, for example be wound with 936 turns of #11 AWG magnet wire at a 0.500 packing factor. The U-shaped core may, for example, be of interleaved construction, 29 GA M6 laminations made of 3.81 cm strip stock, vacuum impregnated. The dimensions shown in FIG. 25 may be, for example, A=10.16 cm, B=3.81 cm, C=7.62 cm and D=7.62 cm. In that case, the resistance would be 6.7 ohms and the inductance 213 NH. Such weighs 22.2 kg and is capable of exerting 578 Newtons.

If we use such an electromagnet actuator in a control system such as described previously we can expect an average delay in responding to a command of, say, 4.2 msec. The time delay to develop a full force, say, of 578 Newton at a maximum gap of 20 mm can be estimated at 15 msec as follows (based on the relation v=Ldi/dt):

$$t=L\ i/v=(0.3)(8.6)/(170)=15 \text{ usec.}$$

The time to develop full force (578 Newton) at minimum gap (5mm) would be:

$$t=L\ i/v=(1.2)(2.15)/(170)\ 15 \text{ asec.}$$

as well.

Figure 27:
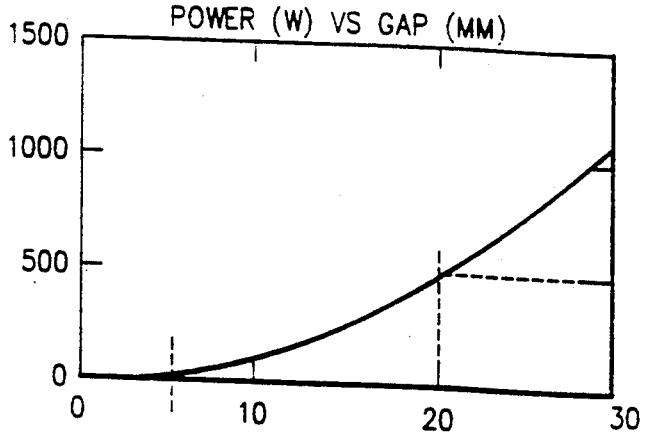
FIG. 27 is a plot of power vs. air gap.
Figure 28:
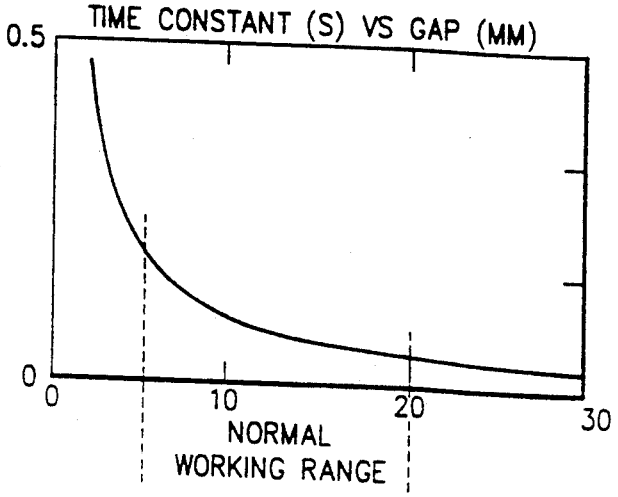
FIG. 28 is a plot of time constant vs. air gap.
Figure 29:
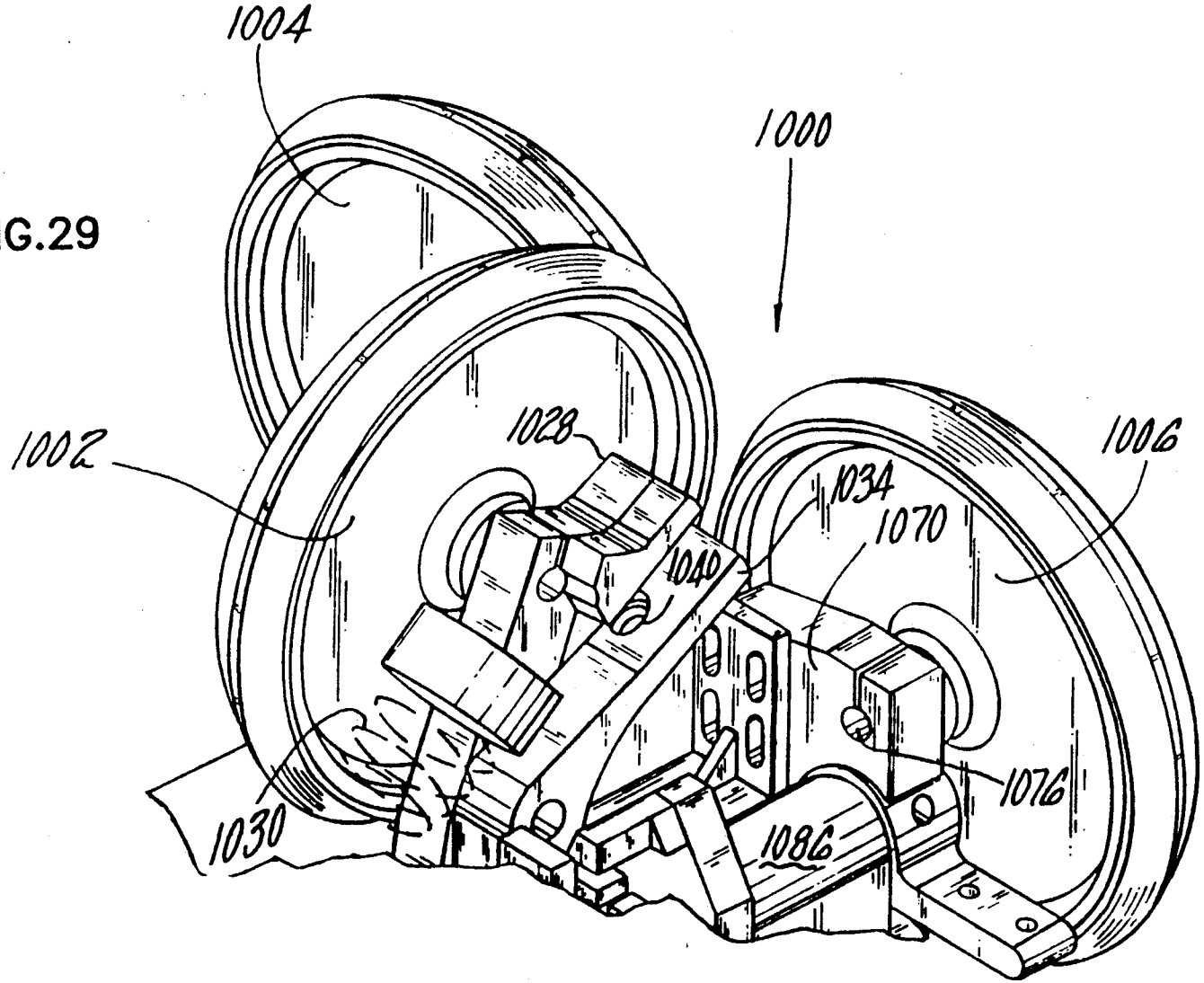
FIG. 29 is a close up perspective view, partly broken away, of rollers included in a guide roller cluster as shown in FIG. 30, according to the present invention.

The time to develop half force would of course be half the time. An accuracy in the gap signal of 10% of full scale can be tolerated. We can present the relation between the gap and several other factors in graphical form as shown in FIGS. 26, 27 and 28. The maximum power is 500 Watts at a maximum allowed 20 mm gap. The average power can be expected to be approximately 125 Watts.

As for short term thermal considerations, the mass of the copper in such an electromagnet is 14.86 kg, having a specific heat of 0.092 cal/g-°C. (=385J/kg°C.). The change in temperature for a sixty second application of energy at a rate of 500 Watts will thus be:

$$T = \text{Watt-sec}/(385)\ (14.86)$$
$$= (500)\ (60)/(385)\ (14.86)$$
$$T = 5.24°\ \text{C.}$$

Thus, there is little temperature rise even for maximum power input for one minute.

Figure 30:
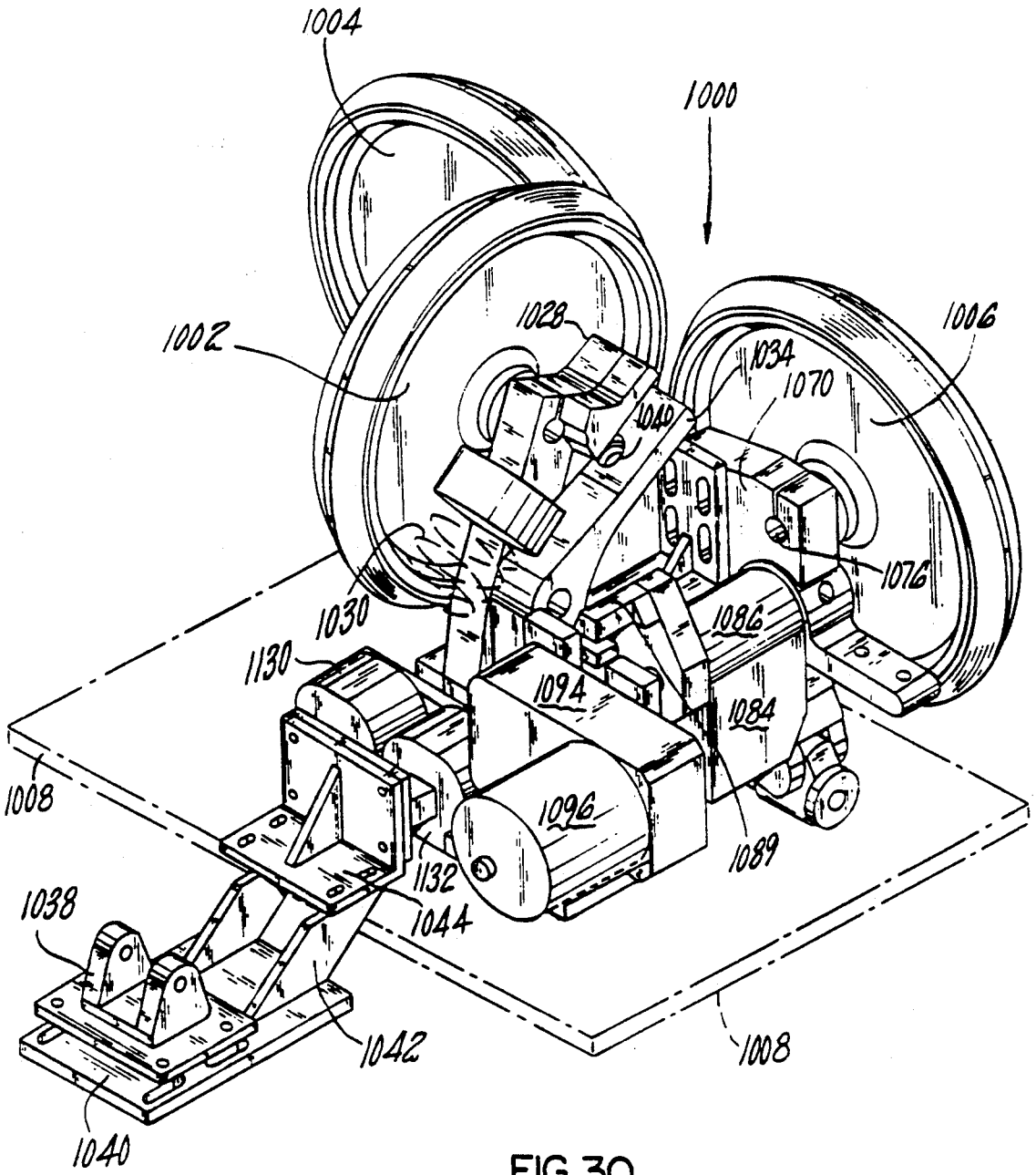
FIG. 30 is a perspective view of a guide roller cluster, according to the present invention.
Figure 31:
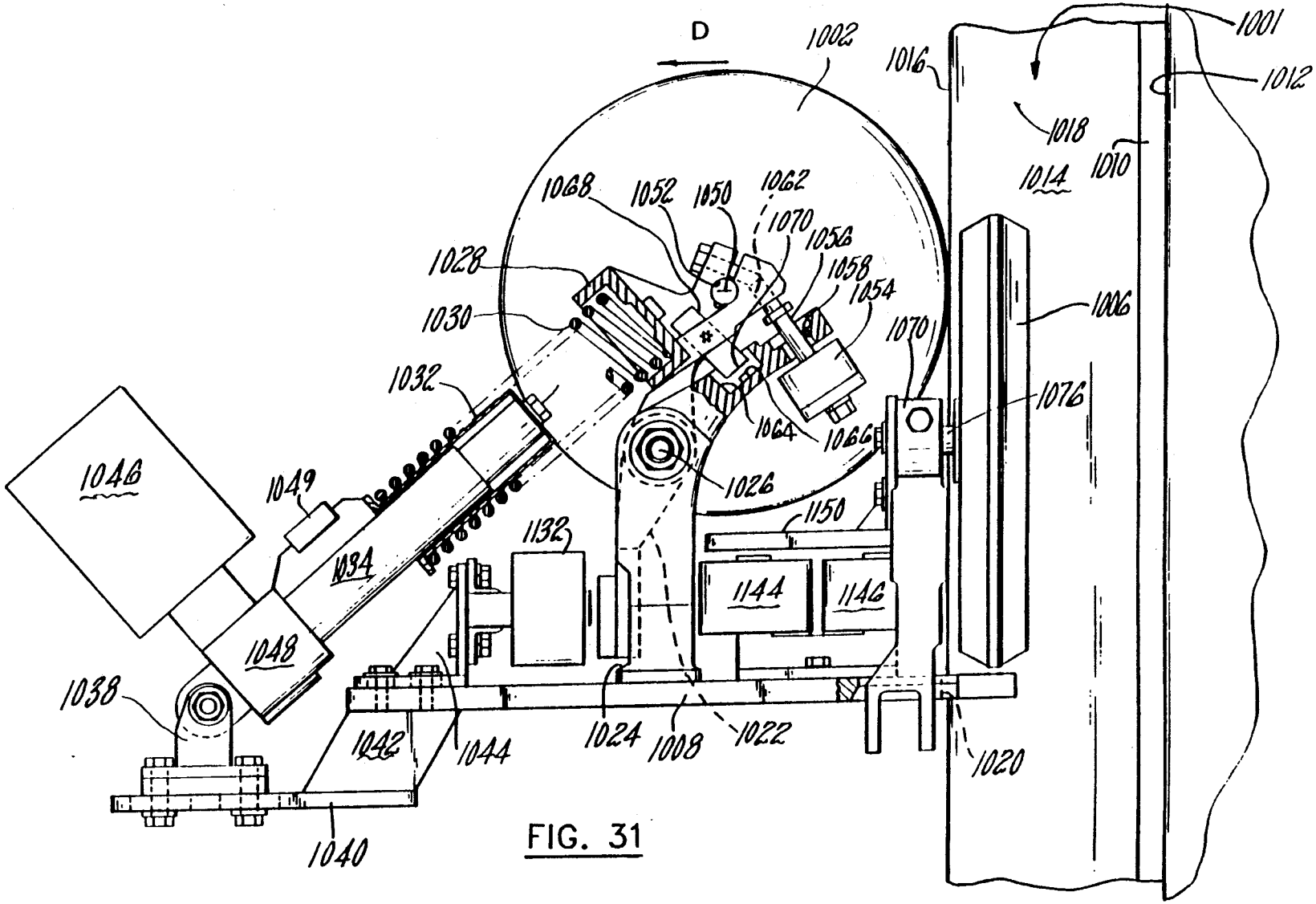
FIG. 31 is a side elevational view of the guide roller cluster of FIG. 30 showing details of the secondary suspension's side-to-side roller adjustment mechanism.

FIGS. 30 and 31 are still other illustrations of an embodiment of means for carrying out the present invention, in the form of an "active" roller guide, showing details of a roller cluster 1000. Although one of the rollers (side-to-side) is elevated with respect to the other two, it will be appreciated that the roller cluster 1000 is a relatively conventional arrangement of rollers on a rail 1001. However, we are only aware of such clusters being used passively and we known of no such prior art roller cluster used with actuators.

The cluster 1000 includes a side-to-side guide roller 1002 and front-to-back guide rollers 1004 and 1006. The roller cluster 1000 is mounted on a base plate 1008 which is fixed to an elevator cab frame crosshead (not shown). The guide rail 1001 will be a conventional, generally T-shaped structure having basal flanges 1010 for securement to the hoistway walls 1012, and a blade 1014 which projects into the hoistway toward the rollers 1002, 1004 and 1006. The blade 1014 has a distal face 1016 which is engaged by the side-to-side roller 1002, and side faces 1018 which are engaged by the front-to-back rollers 1004 and 1006. The guide rail blade 1014 extends through a slot 1020 in the roller cluster base plate 308 so that the rollers 1002, 1004 and 1006 can engage the blade 1014.

As shown most clearly in FIG. 31, the side-to-side roller 1002 is journaled on a link 1022 which is pivotally mounted on a pedestal 1024 via a pivot pin 1026. The pedestal 1024 is secured to the base plate 1008. The link 1022 includes a cup 1028 which receives one end of a coil spring 1030. The other end of the spring 1030 is engaged by a spring guide 1032 which is connected to the end of a telescoping ball screw adjustment device 1034 by a bolt 1036. The adjuster 1034 can be extended or retracted by vary the force exerted on the link 1022, and thus on the roller 1002, by the spring 1030. The ball screw device 334 is mounted on a clevis 1038 bolted to a platform 1040 which in turn is secured to the base plate 1008 by brackets 1042 and 1044. The use of the platform 1040 and brackets 1042 and 1044 allows the assembly to be retrofitted on a conventional roller guide assembly directly on the existing base plate 1008. The ball screw device 1034 is powered by an electric motor 1046. A ball screw actuator suitable for use in connection with this invention can be obtained from Motion Systems Corporation, of Box 11, Shrewsbury, N.J. 07702. The actuator motor 1046 can be an AC or a DC motor, both of which are available from Motion Systems Corporation. The Motion systems Model 85151/85152 actuator has been found to be particularly suitable for use in this invention. These devices have the AC or DC motor 1046 attached to a gear reducer 1048 for motor speed reduction to drive the ball drive actuator which is an epicyclic ball screw 1034, only the cover of which is shown. Or, a brushless DC motor may be provided. Although shown only schematically, a position sensor 1049 such as a potentiometer or optical sensor may be attached to the car frame by attachment to the reductor 1048 to a lip on the rear of the spring holder 1032 in order to measure the linear extension of the screw. Of course, other position sensors may be used as well.

The guide roller 1002 is journaled on an axle 1050 which is mounted in an adjustable receptor 1052 in the upper end of the link 1022. A pivot stop 1054 is mounted on a threaded rod 1056 which extends through a passage 1058 in the upper end 1060 of the pedestal 1024. The rod 1056 is screwed into a bore 1062 in the link 1022. The stop 1054 is operable by selective engagement with the pedestal 1024 to limit the extent of movement of the link 1022 in the counter-clockwise direction about the pin 1026, and therefore limit the extent of movement of the roller 1002 in a direction away from the rail, which direction is indicated by an arrow D. The pedestal 1024 is formed with a wall 1064 containing a magnetic button 1066 which contains a rare earth compound. Samarium cobalt is a rare earth compound which may be used in the magnetic button 1066. A steel tube 1068 which contains a Hall effect detector (not shown) proximate its and 1070 is mounted in a passage which extends through the link 1022. The magnetic button 1066 and the Hall effect detector form a proximity sensor which is operably connected to a switch controlling power to the electric motor 1046. The proximity sensor detects the spacing between the magnetic button 1066 and the steel tube 1068, which distance mirrors the distance between the pivot stop 1054 and the pedestal 1024. Thus as the tube 1068 and its Hall effect detector move away from the magnet 1066, the pivot stop 1054 moves toward the pedestal 1024. The detector produces a signal proportional to the size of the gap between the detector and the magnetic button 1066, which signals is used to control the electric motor 1046 whereby the ball screw 1034 jack is caused to move the link 1022 and roller 1002 toward or away from the rail, as the case may be. Depending on the type of control system employed, the stop 1054 may be prevented from contacting or at least prevented from establishing prolonged contact with the pedestal 1024. This ensures that roller 1002 will continue to be damped by the spring 1030 and will not be grounded to the base plate 1008 by the stop 1054 and pedestal 1024. Side-to-side canting of the car by asymmetrical passenger loading or other direct car forces is also corrected. As mentioned, the electric motors 1046 can be reversible motors whereby adjustments on each side of the cab can be coordinated in both directions, both toward and away from the rails.

Figure 32:
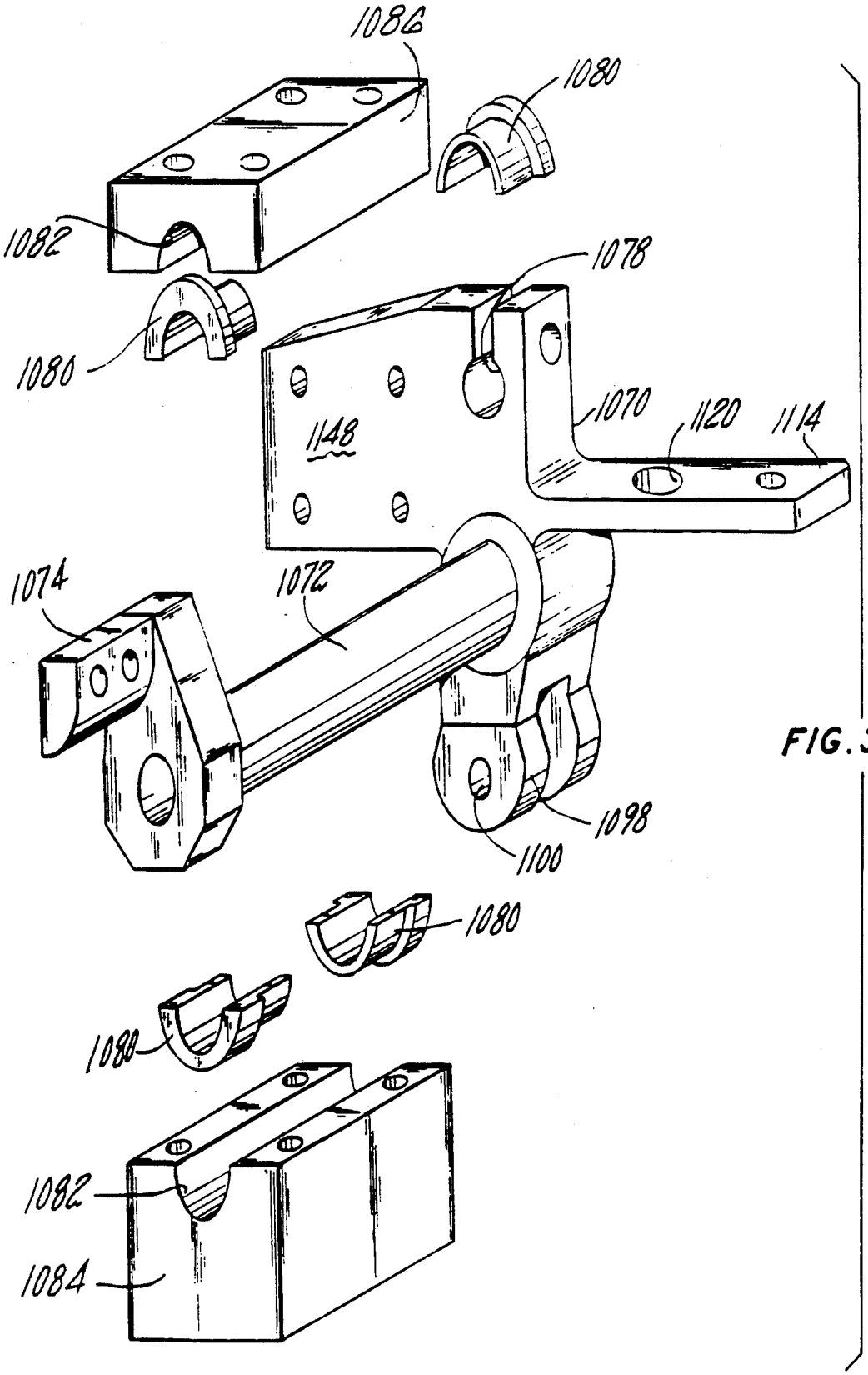
FIG. 32 is an exploded, schematic view of the front-to-back roller adjustment crank to which the spring of FIG. 33 is connected.
Figure 33:
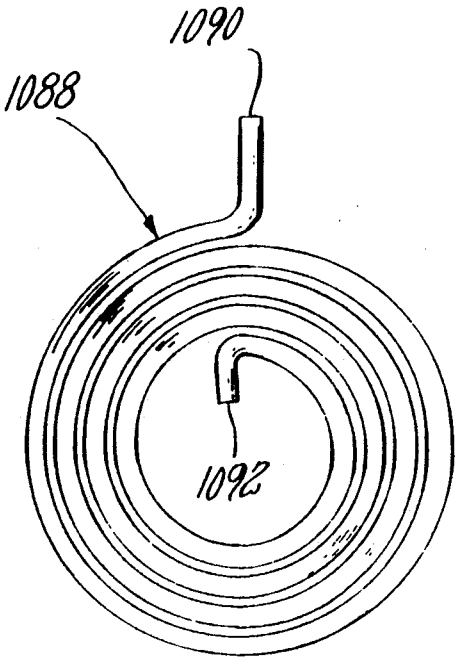
FIG. 33 is a plan view of the flat spiral spring used in the front-to-back guide for damping and adjusting the front and back rollers in the cluster.

Referring now to FIGS. 30, 31 and 32, the mounting of the front and back rollers 1004, 1006 on the base plate 1008 will be clarified. Each roller 1004, 1006 is mounted on a link 1070 connected to a pivot pin 1072 which carries a crank arm 1074 on the end thereof remote from the roller 1004, 1006. Axles 1076 of the rollers 1004, 1006 are mounted in adjustable recesses 1078 in the links 1070. The pivot pin 1072 is mounted in split bushings 1080 which are seated in grooves 1082 formed in a base block 1084 and a cover plate 1086 which are bolted together on the base plate 1008. A flat spiral sprig 1088 (see FIG. 33) is mounted in a space 1089 (see FIG. 30) and has its outer end 1090 connected to the crank arm 1074, and its inner end 1092 connected to a rotatable collar (not shown) which is rotated by a gear train (not shown) mounted in a gear box 1094, which gear train is rotated in either direction by a reversible electric motor 1096. The spiral spring 1088 is the suspension spring for the roller 1006, and provides the spring bias force which urges the roller 1006 against the rail blade 1018. The spiral spring 1088, when rotated by the electric motor 1096 also provides the recovery impetus to the roller 1066 through crank arm 1074 and pivot pin 1072 to offset cab tilt in the front-to-back directions caused by front-to-back direct car forces such as asymmetrical passenger loading of the car.

A rotary position sensor (not shown) such as an RVDT, a rotary potentiometer or the like, may be provided for measuring the position of the actuator with respect to the car. Such sensor may be attached at one end to the crank arm 1074 and on the other to the base 1008.

Figure 34:
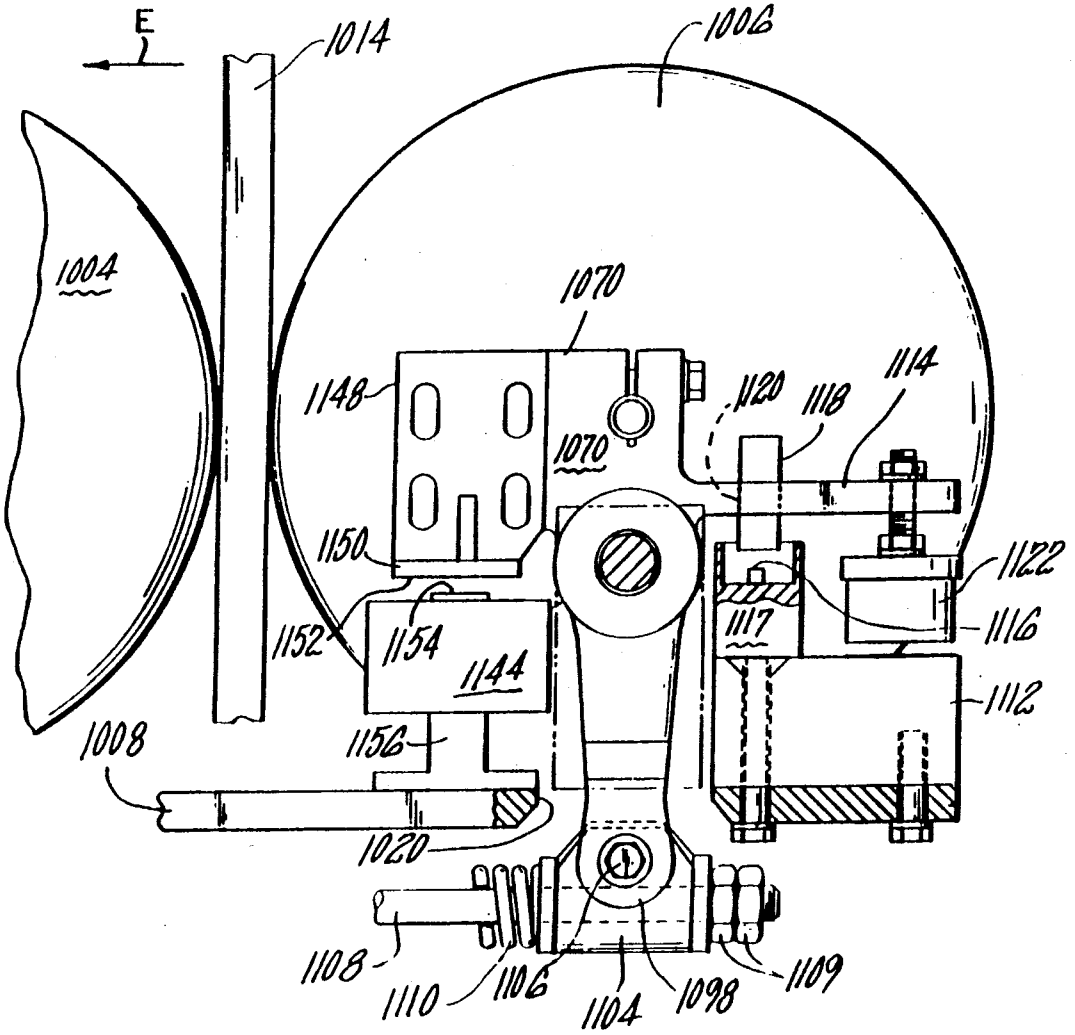
FIG. 34 is a front elevational view of the front and back guide rollers of the cluster.

Each roller 1004 and 1006 can be independently controlled as shown below in FIG. 43, by respective electric motors and spiral springs if desired, or they can be mechanically interconnected and controlled by only one motor/spring set, as shown in FIGS. 30 and 34. Details of an operable interconnection for the rollers 1004 and 1006 are shown in FIG. 34. It will be noted in FIGS. 32 and 34 that the links 1070 have a downwardly extending clevis 1098 with bolt holes 1100 formed therein. The link clevis 1098 extends downwardly through a gap 1102 in the mounting plate 1008. A collar 1104 is connected to the clevis 1098 by a bolt 1106. A connecting rod 1108 is telescoped through the collar 1104, and secured thereto by a pair of nuts 1109 screwed onto threaded end parts of the rod 1108. A coil spring 1110 is mounted on the rod 1108 to bias the collar 1104, and thus the link 1070 in a counter-clockwise direction about the pivot pin 1072, as seen in FIG. 34. It will be understood that the opposite roller 1004 has an identical link and collar assembly connected to the other end of the rod 1108 and biased by the spring in the clockwise direction. It will be appreciated that movement of the link 1070 in clockwise direction caused by the electric motor 1096 will 1070 in clockwise direction caused by the electric motor 1096 will also result in movement of the opposite link in a counter-clockwise direction due to the connecting rod 1108. At the same time, the spring 1110 will allow both links to pivot in opposite directions if necessary due to discontinuities on the rail blade 1018. A flexible and soft ride thus results even with the two rollers links tied together by a connecting rod.

As shown in FIG. 34, a stop and position sensor assembly similar to that previously described is mounted on the link 1070. A block 1112 is bolted to the base plate 1008 below an arm 1114 formed on the link 1070. A cup 1116 is fixed to the block 1112 and contains a magnetic button 1116 formed from a rear earth element such as samarium cobalt. A steel tube 1118 is mounted in a passage 1120 is the link arm 1114, the tube 1118 carrying a Hall effect detector in its lower end so as to complete the proximity sensor which monitors the position of the link 1070. A pivot stop 1122 is mounted on the end of the link arm 1114 opposite the block 1112 so as to limit the extent of possible pivotal movement of the link 1070 and roller 1006 away from the rail blade 1014. The distance between the pivot stop 1122 and block 1112 is proportional to the distance between the Hall effect detector and the magnetic button 1116. The Hall effect detector is used as a feedback signal operable to activate the electric motor 1096, for example, whenever the stop 1122 comes within a preset distance from the block 1112, whereupon the motor 1096 will pivot the link 1070 via the spiral spring 1088 to move the stop 1122 away from the block 1112 or, as another example, in a proportional, proportional-integral, or proportional-integral-derivative type feedback loop so that the position signal is compared to a reference and the difference therebetween is more or less continually zeroed by the loop. The position sensor 1049 of FIG. 31 may also be used to keep track of the position of the actuator with respect to the base 1008 as described below in connection with FIG. 43. In any event, this movement will push the roller 1006 against the rail blade 1014 and will, through the connecting rod 1108, pull the roller 1004 in the direction indicated by the arrow E, in FIG. 34. The concurrent shifting of the rollers 1004 and 1006 will tend to rectify any cant or tilting of the elevator cab in the front-to-back direction caused, for example, by asymmetrical passenger loading.

Figure 35:
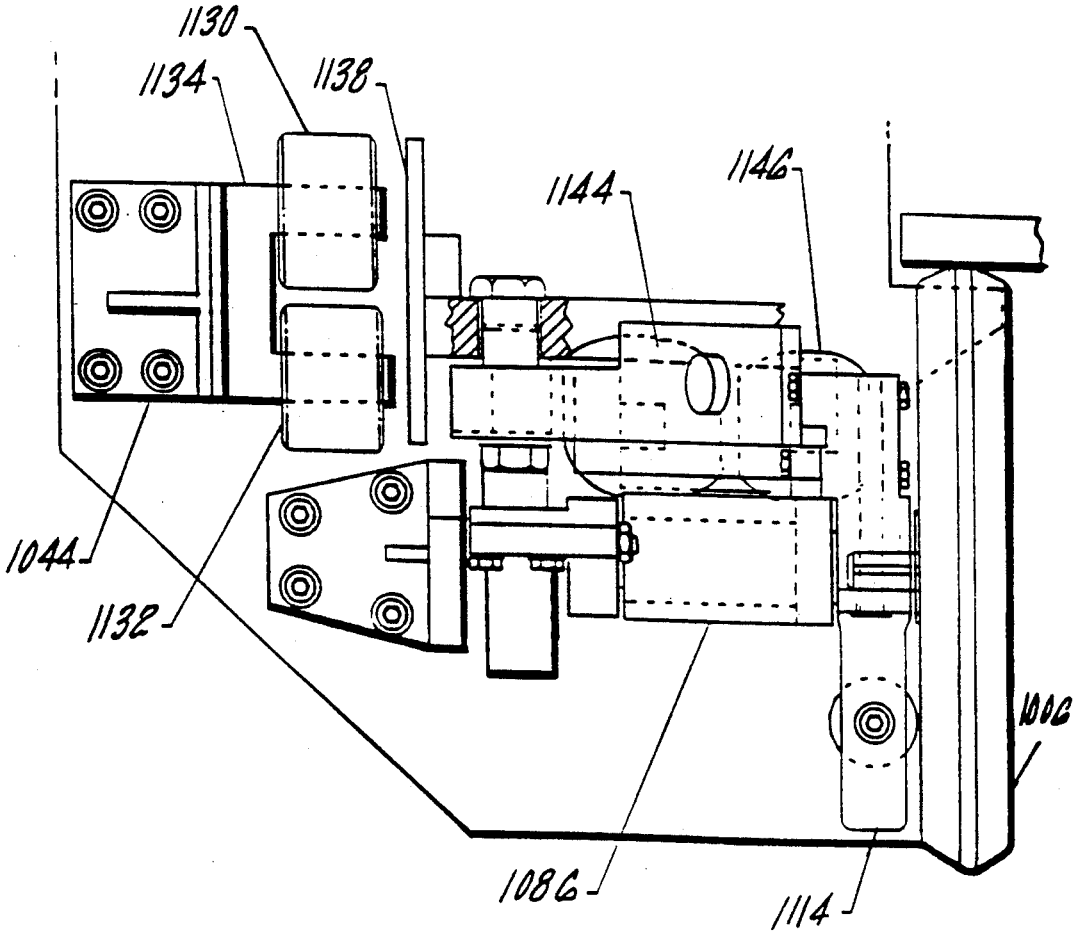
FIG. 35 is a partial plan view of a guide and one of the rollers of the guide rail cluster of the guide of FIG. 30 showing the positioning of the electromagnets of a relatively small-force actuator.

Referring now to FIGS. 30, 31 and 35, an electromagnet with coils 1130, 1132 is mounted on a U-shaped core 1134 which is in turn mounted on the bracket 1044. The bracket 1044 is itself mounted on the base plate 1008. As previously described, the shaft 1034 of the ball drive exerts forces along the axis of the ball screw against the pivoted link 1022. The link 1022 pivots at the point 1026 and extends down below the pivot point to the electromagnet coils 1130, 1132 and has a face 1138 separated from the core faces of the electromagnet core 1134 for receiving electromagnetic flux across a gap therebetween.

Figure 36:
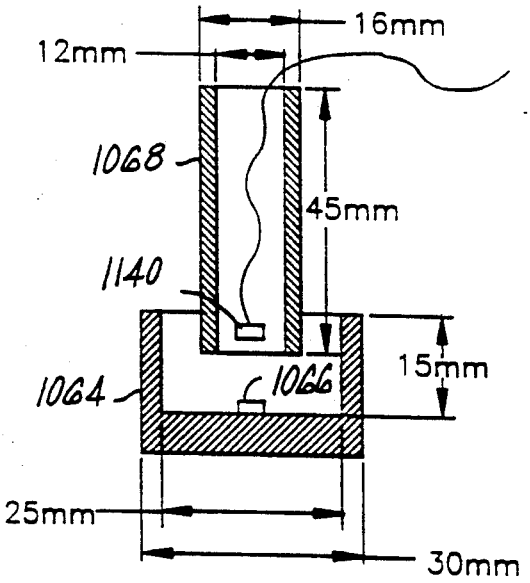
FIG. 36 shows a gap sensor.

FIG. 36 is an illustration of the cup 1064, which should be of ferromagnetic material, with the rare earth magnet 1066 mounted therein. The depression in the cup may be 15 mm deep and have an inside diameter of 25 mm and an outside diameter of 30 mm, as shown, for example. The sleeve 1068 may have a length of 45 mm with an inside diameter of 12 mm and an outside diameter of 16 mm, for example. A hall cell 1140 is shown positioned near the opening of the tube 1068 so as to be in position to sense the flux from magnet 1066. The composition of the tube is ferromagnetic, according to the teachings of the present invention, in order to enhance the ability of the hall call to sense the flux from the magnet and also to provide shielding from flux generated by the electromagnets mounted elsewhere on the roller guide.

| Specification for Position Transducers | |
|---|---|
| 1. Magnetic transducer may be used. | |
| 2. Operating Range: | 10 mm |
| 3. Repeatability: | 0.1 mm |
| 4. Temperature Range: | 0–55 C. |
| 5 Temperature Coef.: | <.02%/C. |
| 6. Magnetic Field Sensitivity: | 100 Gauss at a distance of 30 mm should not affect transducer output by more than 0.5%. |
| 7. Power Voltage: | 9–15 VDC |
| 8. Leads: | Use separate signal and power grounds. Use twisted shielded pairs. |

Figure 37:
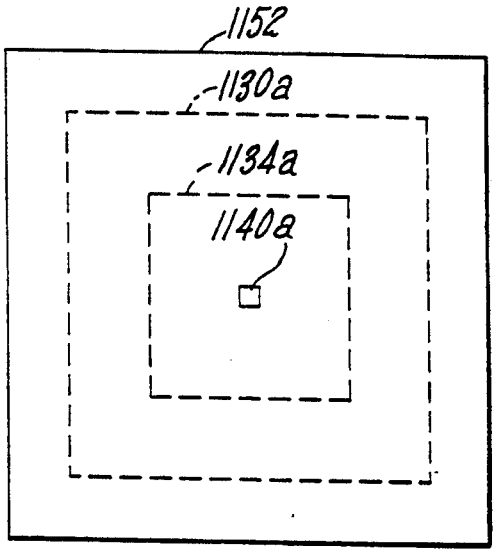
FIG. 37 shows a flux sensor which maybe used in the acceleration loop of FIG. 43.

FIG. 37 shows such a hall cell 1140*a* mounted on a face of the reaction plate 11138 with a projection 1134*a* of the electromagnet core 1134 onto the plate 1138 associated with coil 1130 (shown also in a projection 1130*a*) shown in FIG. 30, 31 and 35. The sensor can also be mounted on the face of the core itself but could get overheated in that position.

| Specification for Hall Sensor Assembly | |
|---|---|
| 1. Application is on or opposite face of electromagnet. | |

-continued

| Specification for Hall Sensor Assembly | |
|---|---|
| 2. Operating Range: | .05 to 1.0 Tesla |
| 3. Accuracy: | 5% tolerable, 2% desired |
| 4. Scale Factor: | 10 V/Tesla |
| 5. Temperature Range: | 0–55 C. |
| 6. Temperature Coef.: | <.02%/C. |
| 7. Thickness: | Must not exceed 2.0 mm |
| 8. Power Voltage: | ±12 to 15 VDC |
| 9. Leads: | Use separate signal and power grounds. Use twisted shielded pairs. |

turning again now to the front-to-back roller 1006, a pair of electromagnets 1144, 1146 is shown in FIG. 31. A block 1148 portion of link 1070, shown in FIG. 32 in perspective and in FIG. 34 in section, has an extension 1150 shown in FIGS. 31 and 34 (not shown in FIG. 32) having a face 1152 opposite a pair of core faces associated with a core 1156 upon which coils 1144, 1146 are mounted, only one face 1154 of which is shown in FIG. 34.

Figure 38:
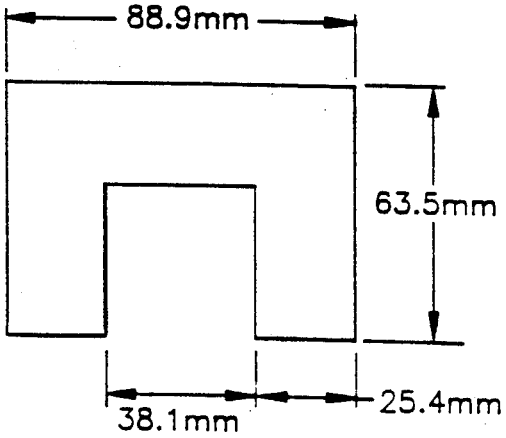
FIG. 38 shows a side view of an electromagnet core.
Figure 39:
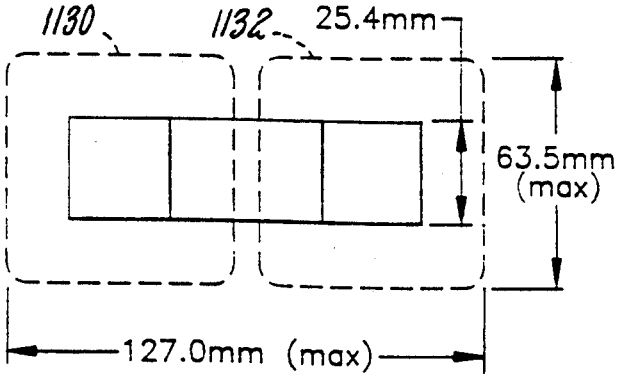
FIG. 39 shows a top view of the core of FIG. 38 with coils in phantom.

FIG. 38 is a side view of a ferromagnetic core such as is used for mounting the coils 1130, 1132 of FIG. 30 or the coils 1144, 1146 of FIG. 31. The dimensions shown are in millimeters. FIG. 39 shows a top view of the same core with the depth dimensions shown along with a pair of coils shown in dashed lines. The core of FIGS. 38 and 39 may be made of grain-oriented (M6) 29 gauge steel, mounted on an angle iron by means of a weld, for example. The coils 1130, 1132, for example, will be required in pairs, each having, for example, 1050 turns of wire having a diameter of 1.15 mm. The coil connection should be series with the possibility made for parallel reconnection. The wire insulation can be heavy (double) build GP200 or equivalent rated at 200C. The impregnation can be vacuum-rated at 180C or higher. The coil working voltage may be on the order of around 250 volts and the coil itself may be high potential to ground tested at 2.5 kilovolts or similar, as required. The coil leads for hookup may be stranded wire, having a diameter of 1.29 mm, and about 50 centimeters in length. The weight is approximately 2.0 kilograms, consisting of 0.8 kg of iron and 1.2 kg of copper. At an air gap of 2–10 mm with a flux density of about 0.6 Tesla, a force of about two hundred Newtons can be achieved. Such a design is adequate for the active roller guide disclosed above. It has a force capability reserve of more than twice needed.

Figure 40:
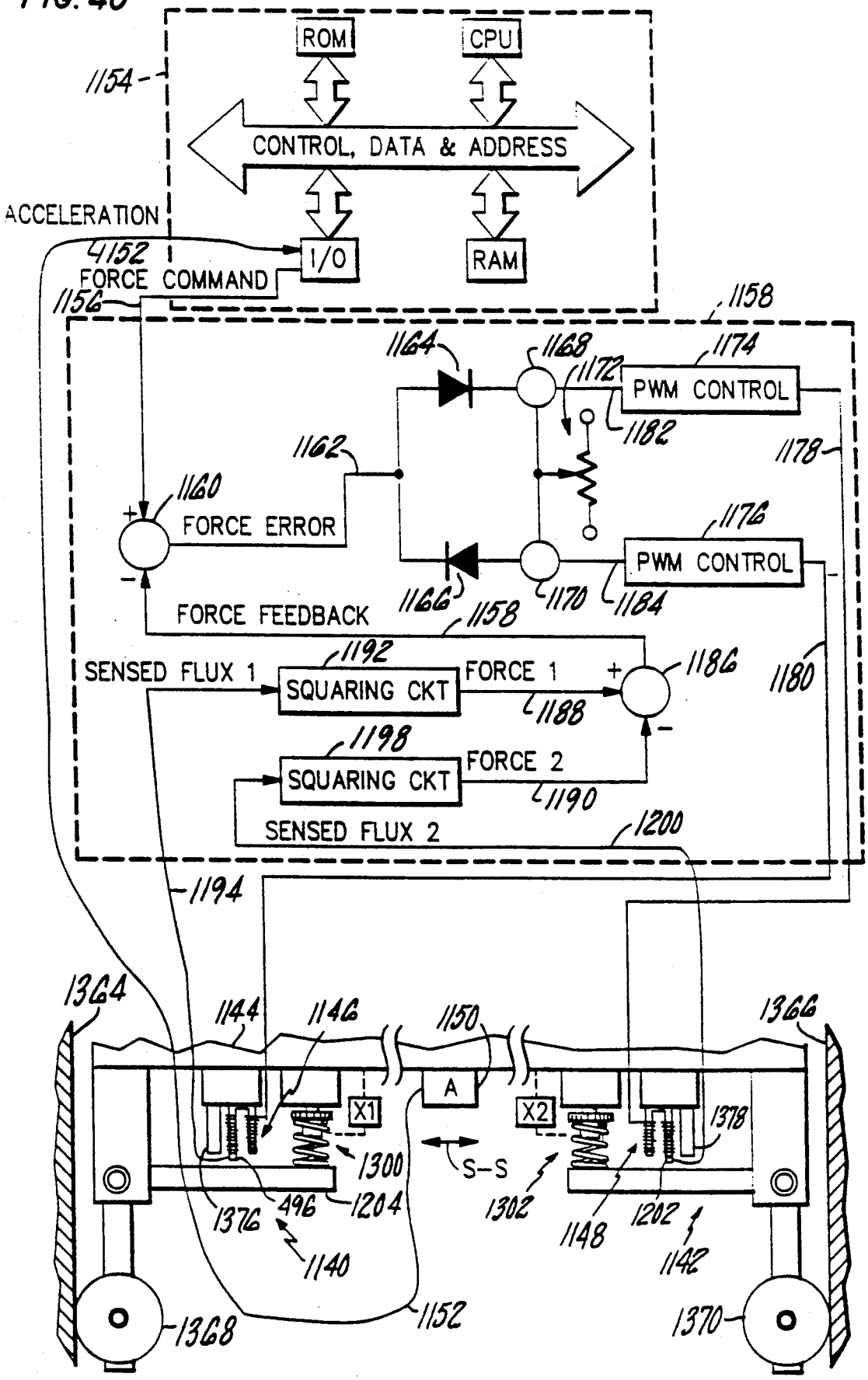
FIG. 40 is a simplified block diagram of a steering circuit for controlling two active guide situated on opposite sides of an elevator car for side-to-side control but which may be used for front-to-back control of guides on opposite sides of a rail blade.

FIG. 40 illustrates a pair of active roller guides 1140, 1142 mounted on the bottom of an elevator car 1144 for side-to-side control. FIG. 40 also illustrates a control for a corresponding pair of electromagnets 1146, 1148. Acceleration feedback is utilized in the described control circuit for the electromagnets, although other means of control may be used. Acceleration control will be described in detail in conjunction with position control of the high-force actuators in connection with FIG. 43. An accelerometer 1150 measures the side-to-side acceleration at the bottom of the platform, and it may be positioned in between the two active roller guides 1140, 1142. The direction of sensitivity of the accelerometer is shown by an arrow labeled S—S and would be perpendicular to the hoistway walls. A sensed signal on a line 1152 is provided to a signal processor 1154 which, in response thereto, provides a force command signal on a line 1156 to a second signal processor 1158 which may be made up of discrete components in order to provide faster response. The force command signal on line 156 is summed with a force feedback signal on a line 1158 in a summer 1160 which provides a force error signal on a line 1162 to a steering circuit comprising a pair of diodes 1164, 1166. A positive force error signal will result in conduction through diode 1164 while a negative force error signal will result in conduction through diode 1166. In order to prevent abrupt turn-on and turn-off, action of the two electromagnets 1146, 1148 near the crossover between positive force response and negative force response as shown in FIG. 41, a bias voltage is provided to bias the left and right signals provided to the PWM controls. This is done by means of a pair of summers 1168, 1170 from a potentiometer 1172 which is biased with an appropriate voltage to provide the force summation technique illustrated in FIG. 41. This allows a smooth transition between the two electromagnets. A pair of pulse width modulated controls 1174, 1176 are responsive to summed signals from the summers 1168, 1170 and provide signals on lines 1178, 1180 having variable duty cycles according to the magnitudes of signals on line 1182, 1184 from the summers 1168, 1170, respectively.

The force feedback on line 1158 is provided from a summer 1186 responsive to a first force signal on a line 1188 and a second force signal on a line 1190. A squaring circuit 1192 is responsive to a sensed flux signal on a line 1194 from a Hall cell 1196 and provides the first force signal on line 1188 by squaring and scaling the flux signal on line 1194. Similarly, a squaring circuit 1198 is responsive to a sensed flux signal on a line 1200 from a Hall call 1202. The pair of Hall cells 1196, 1202 are mounted on or opposite one of the core faces of their respective electromagnets in order to be in a position to sense the flux between the electromagnet and the respective arms 1204, 1206 of the roller guides 1140, 1142.

The signal processor 1154 of FIG. 40 will be programmed to carry out the compensation described in detail in connection with FIGS. 18 and 24.

Figure 42B:
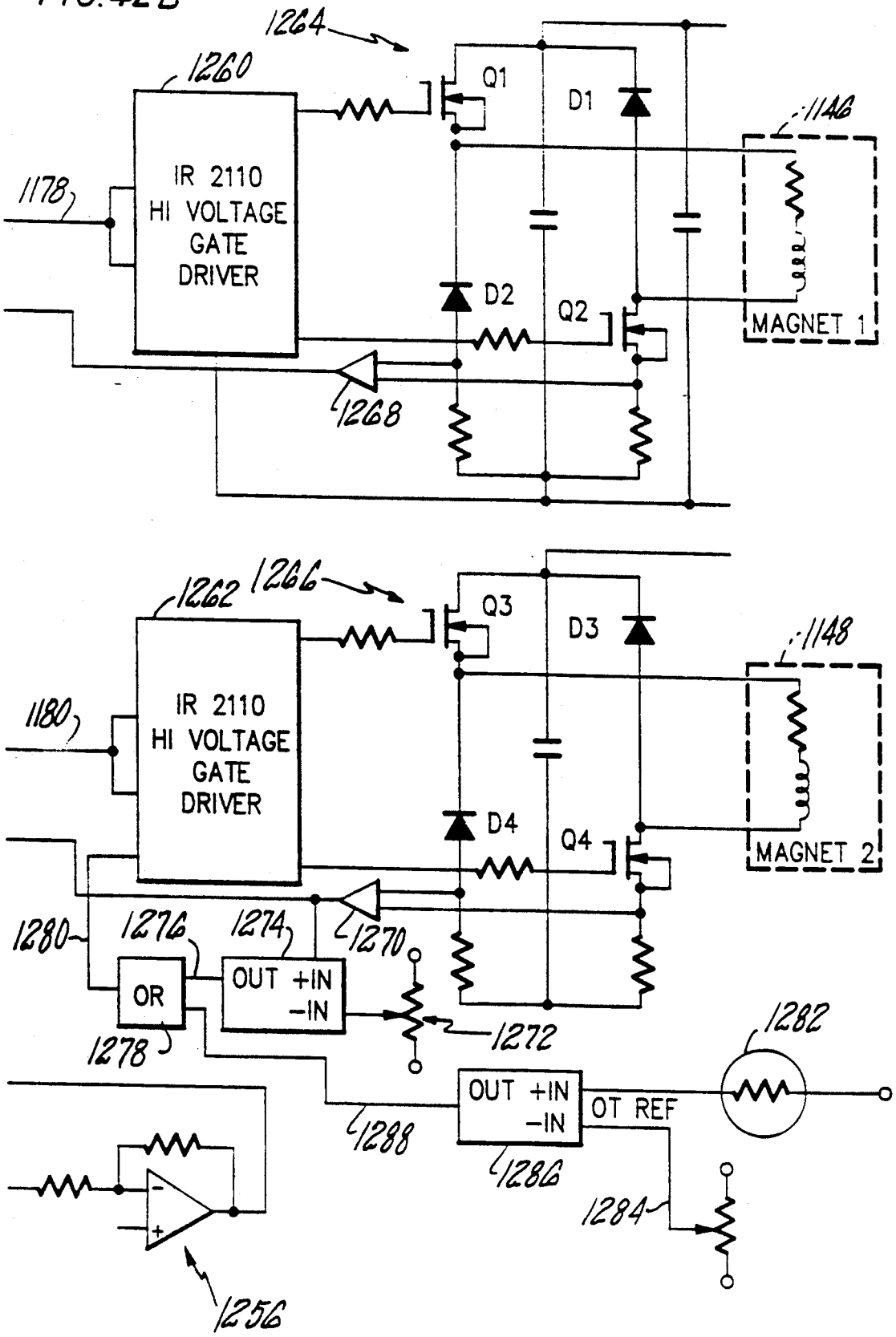

The signal processor 1158 of FIG. 40 is shown in more detail in FIG. 42. There, an integrated circuit 1230, which may be an Analog Device AD534, is responsive to the force command signal on line 1156, the first flux signal on line 1194, and the second flux signal on line 1200 and provides the force error signal on line 1162 as shown in FIG. 40. A PI controller 1252 amplifiers the force error signal and provides an amplified signal on a line 1254 to a 100 volt per volt (gain of 100) circuit to the precision rectifier or diode steering circuits 1164, 1166, similar to that shown in simplified form in FIG. 40. An inverter 1258 inverts the output of steering circuit 1164 so that signals on lines 1260, 1262 applied to summers 1168, 1170 are of corresponding polarities. The summed signals on lines 1182, 1184 are provided to PWM controllers which may be a Signetics NE/SE 5560 types controllers. These provide variable duty cycle signals on the lines 1178, 1180, which are in turn provided to high voltage gate driver circuits 1260, 1262 which in turn provide gating signals for bridge circuits 1264, 1266 which provide current to the electromagnets 1146, 1148.

Amplifiers 1268, 1270 monitor the current in the bridge and provide a shutdown signal to the PWM controls 1174, 1176 in the presence of an overcurrent.

Also, a reference signal can be provided by a potentiometer 1272 to a comparator 1274 which compares the output of current sensor 1270 to the reference signal and provides an output signal on a line 1276 to an OR gate 1278 which provides the signal on line 1276 as a signal on a line 1280 to the high voltage gate driver 1262 in the case where the signal from the current sense 1270 exceeds the reference from reference potentiometer 1272. Also, a thermistor or thermocouple can be used on the heat sink of the circuit shown in order to be compared to an over-temperature reference signal on a line 1284 in a comparator 1286. The comparator 1286 will provide an output signal on a line 1288 to the OR gate 1278 in cases where the temperature of the heat sink exceeds the over-temperature reference. In that case, the signal on the line 1280 is provided to the high voltage gate driver to shut down the H-bridge. Although most of the above-described protective circuitry of a current and over-temperature is not shown for the H-bridge for magnet number 1 (1146), it should be realized that the same can be equally provided for that bridge, but is not shown for purposes of simplifying the drawing.

Figure 43A:
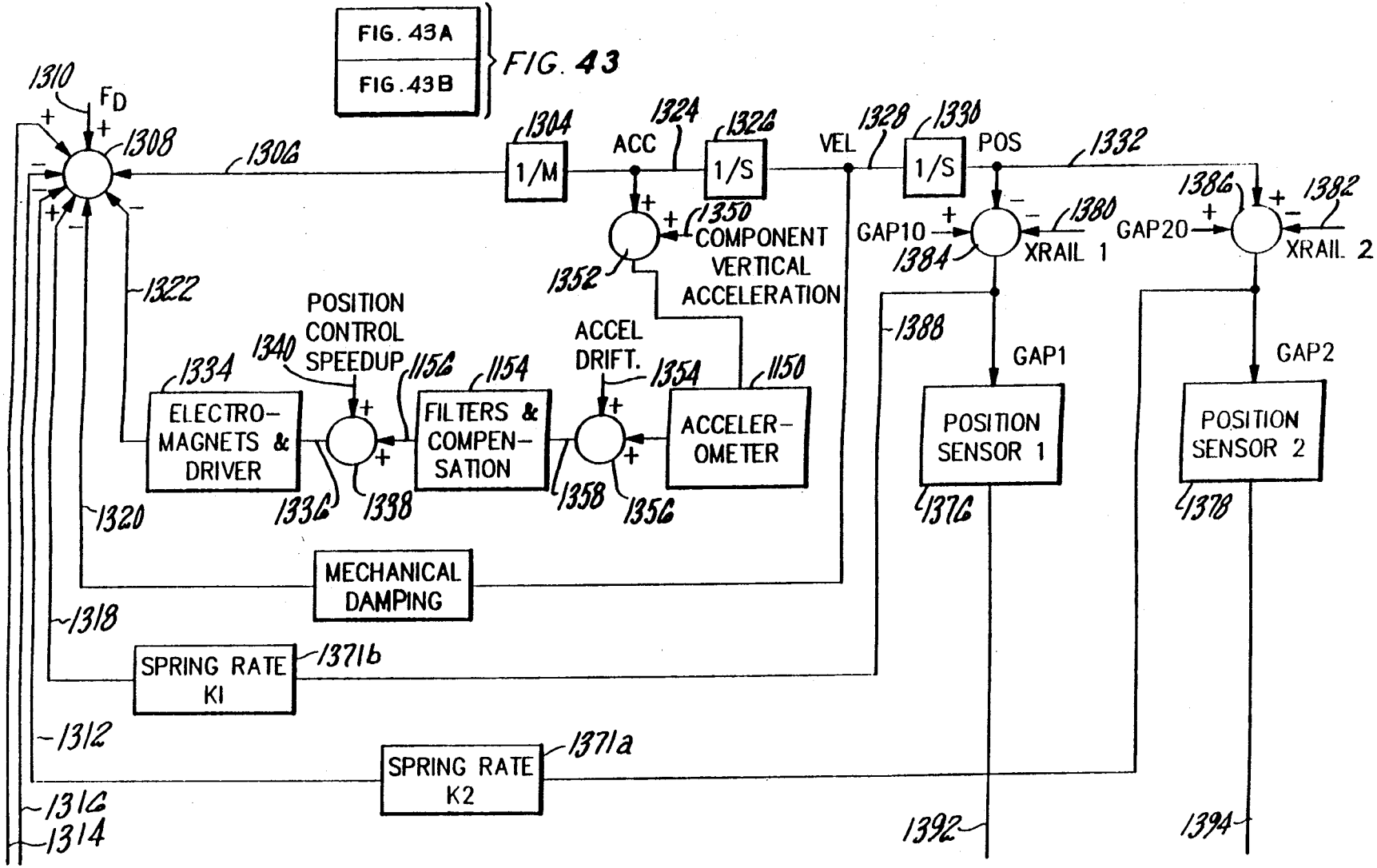
Figure 43B:
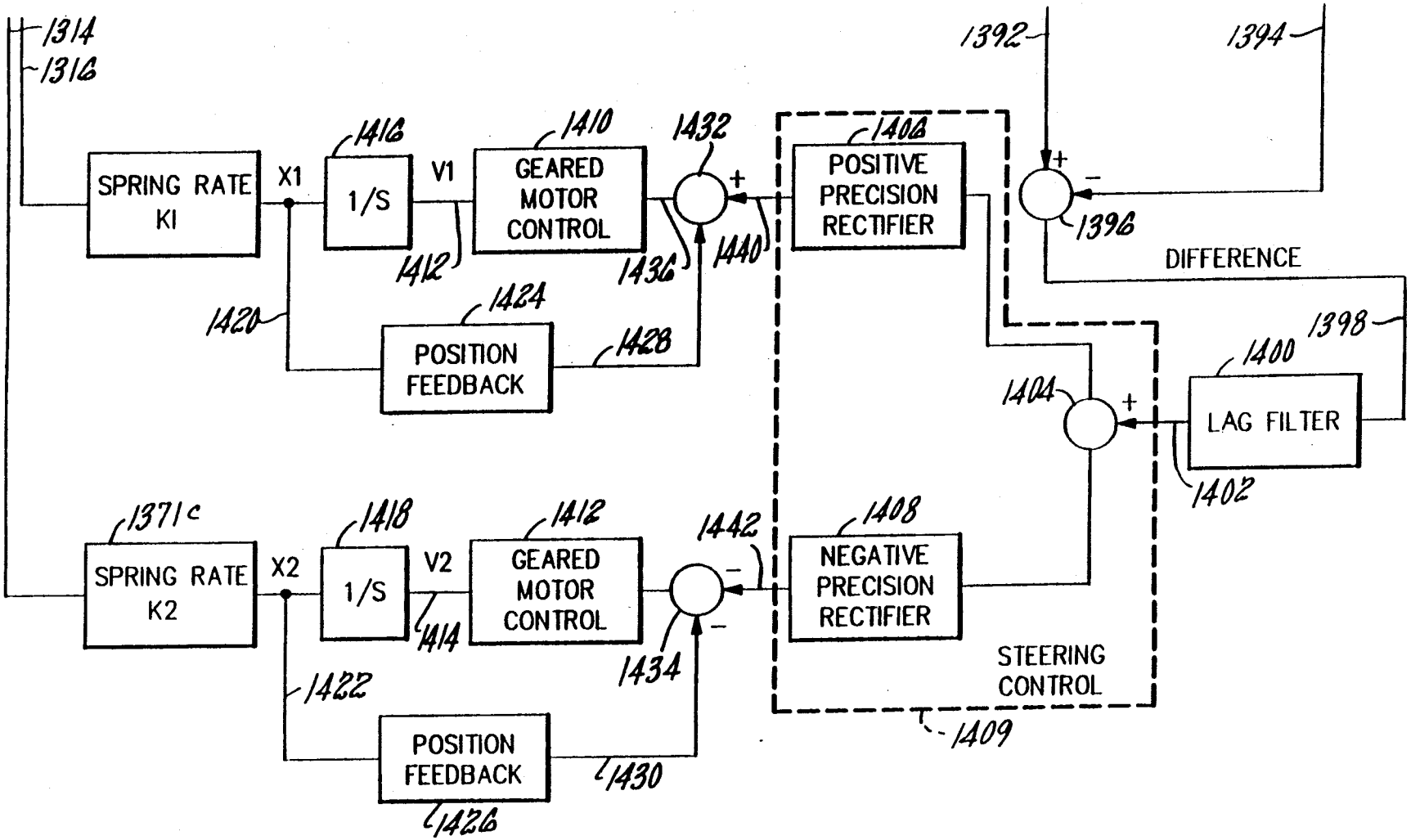

Turning now to FIG. 43, a system-level diagram is presented to show a control scheme for a pair of opposed guides such as the side-to-side active roller guides 1140, 1142 of FIG. 40. The diagram includes both acceleration feedback as described, for example, in detail above for the pair of small actuators 1146, 1148 and position feedback for a pair of high-force actuators such as the screw actuators 1300, 1302. It will be recalled that each roller 1004 and 1006 can be independently controlled, as shown below in FIG. 43, by respective electric motors and spiral springs if desired, or they can be mechanically interconnected and controlled by only one motor/spring set, as shown in FIGS. 30 and 34. It should therefore be understood that the scheme of FIG. 43 for independent control is, with slight modification as explained below, also applicable to opposed (on opposite sides of the same rail blade) guides that are linked, as in front-to-back suspensions linked in a way such as or equivalent to that shown in FIG. 34.

The elevator car mass 1304 is shown in FIG. 43 being acted on by a net force signal on line 1306 from a summer 1308 which is responsive to a disturbing force on a line 1310 and a plurality of forces represented on lines 1312, 1314, 13113, 1318, 1320, and 1322, all for summation in the summer 1308. The disturbing force on line 1310 may represent a plurality of disturbing forces, all represented on one line 1310. These disturbing forces may include direct car forces or rail-induced forces. The distinction between the two types of forces is that direct car forces tend to be higher forces, but slower acting, such as wind, or even static, such as load imbalances, while rail-induced forces are low force disturbances at higher frequencies. The forces represented on lines 1312–1322 represent forces which counteract the disturbing forces represented on line 1310. In any event, the net force on line 1306 causes the elevator mass 1304 to accelerate as manifested by an acceleration as shown on a line 1324. The elevator system integrates the acceleration as indicated by an integrator 1326 which is manifested by the car moving at a certain velocity as indicated by a line 1328 which is in turn integrated by the elevator system as indicated by an integrator 1330 into a position change for the elevator car mass as indicated by a line 1332.

Both of the electromagnets 1146, 1148 and driver, as represented by the signal processor 1158 of FIG. 40, are together represented in FIG. 43 as a block 1334 responsive to a signal on a line 1336 from a summer 1338 which is in turn responsive to the force command signal on line 1156 from the digital signal processor 1154 of FIG. 40, represented in FIG. 43 as a "filters & compensation" block similarly numbered as 1154. This block carries out the compensation and filtering described in detail in connection with FIG. 18. A position control speed-up signal on a line 1340 may be provided from the gap error signal on line 1398. Suffice it to say that the speed-up signal may be used to permit the fast control to assist the slow control. Such assistance is also inherently provided by direct sensing by the accelerometer. The accelerometer 1150 of FIG. 40 is shown in FIG. 42 being responsive to the elevator car acceleration, as represented on line 1324 but as also corrupted by a vertical component of acceleration, as shown on a line 1350, being summed with the actual acceleration in a summer 1352. Thus, the side-to-side acceleration shown in FIG. 40 on the line labeled S—S may be corrupted by a small vertical component so that the signal on line 1152 is not a completely pure side-to-side acceleration. Similarly, the accelerometer is subject to drift, as shown on a signal line 1354 which may be represented as being summed with the output of the accelerometer 1150 in a summer 1356 to model a spurious acceleration signal. Finally, a sensed acceleration signal is provided on a line 1358 to the processor 1154. That finishes the description of the acceleration loop.

It will be appreciated that the two electromagnets 1146, 1148 of FIG. 40 do not present a problem of "opposition" or "fighting each other because of the fact that control is steered between the two. For the case of two opposed, large size actuators, e.g., the two ball-screw actuators 1300, 1302, we have a similar problem in operating them independently since they may end up "fighting" each other. Now we shall present a concept for controlling the two high-force actuators 1300, 1302 of FIG. 40 by steering actuation to one or the other of the actuators.

The novel technique of developing a centering command signal and the steering of that signal to control two opposed actuators, as shown in FIG. 43, will be explained in conjunction with FIG. 44. Reference points are marked by zeros. A pair of elevator hoistway walls 1360, 1362 has a corresponding pair of rails 1364, 1366 attached thereto. Upon the surface of each rail a primary suspension, such as a roller 1368, 1370 rolls on a surface of the corresponding rail at a distance respectively labeled XRAIL2 and XRAIL1. A spring constant K2, shown in FIG. 43 as a block 1371*a*, acts between rollers 1368 and actuators 1300 while spring constant K1, shown in FIG. 43 as a block 1371*b*, acts between roller 1370 and actuator 1302. The position of the actuator 1300 with respect to the car 1304 is indicated by a distance K2 while the distance between the car 1304 and the centered position 1371 is indicated by a distance POS with positive to the right and negative tot he left of center. The distance between the elevator car 1304 and the surface of the rail 1364 is indicated by a distance GAP2, and thus the distance between the actuator 1300 and the surface of the rail is GAP2-X2. GAP20 represents the distance between the hoistway wall 1360 and the car 1304 when the car is centered. Similar quantities are shown on the other side of the car.

Referring now back to FIG. 43, a position sensor similar to the sensor 1066, 1070 of FIG. 31 is shown as a block 1376 for measuring the distance GAP1 in FIG. 44. Similarly, a position sensor 1378 measures the quantity GAP2 of FIG. 44. It should be understood that although a pair of sensors 1376, 1378 are shown in FIGS. 40 and 43, such function of measuring the gasp (GAP1 and GAP2) may be carried out by a single sensor albeit without the self centering quality of the signal obtained by taking the difference between two GAP signals. It will be realized by examination of FIG. 43 that the measured quantities are related to the quantities shown in FIG. 44 by the following equations:

$$GAP1 = -POS - XRAIL1 + GAP10, \text{ and}$$

$$GAP2 = POS - XRAIL2 + GAP20.$$

It will be noted that FIG. 43 is similar to FIG. 18 in many respects, except there are two position sensors 1376, 1378 responsive to the position (POS) of the cab, as indicated on the line 1332 and also the additional inner loops having position sensors for retracting the large actuators back to the home or zero position whenever not being actively used as an actuator. In FIG. 44, two gap position lines (GAP10 and GAP20) represent the distances between the car and the hoistway walls when the car is centered. These are further represented as "signals" being injected into "summers" 1384, 1386 in producing the physical gaps indicated as GAP1 and GAP2 lines 1388, 1390. These are useful for understanding the system.

Output signals from position sensors 1376, 1378 are provided on respective signal lines 1392, 1394 to a summer 1396 which takes the difference between the magnitudes of the two signals and provides a difference (centering control) signal on a line 1398 to a lag filter 1400 which provides a filtered centering control signal on a line 1402 to a junction 1404 which provides the filtered difference signal to each of a pair of precision rectifiers 1406, 1408 which together with the junctions 1404 comprise a steering control 1409 for steering the filtered centering signal on the line 1402 to one or the other at a time, i.e., not both at the same time. A pair of geared motor controls 1410, 1412 is shown, one of which will respond to the steered centering command signal by moving at a relatively slow velocity as indicated on a line 1412 or 1414 as integrated by the system as indicated by integration blocks 1416 or 1418 to an actuator position (X1 or X2) as indicated on a line 1420 or 1422 for actuating a spring rate 1371*d* or 1371*c* for providing the force indicated by line 1316 or 1314. It should be realized that in this control system diagram, the spring rates 1371*b* and 1371*d* are associated with the same spring which is actuated by actuator 1410. Similarly, spring rates 1371*a* and 1371*c* are associated with the same spring, in this case actuated by actuator 1412. A pair of position feedback blocks 1420, 1422 are responsive to the actuator positions indicated by lines 1420, 1422 and include position sensors for providing feedback position signals on lines 1428, 1430 indicative of the position of the actuator with respect to the car. These position signals may be subjected to signal conditioning which may comprise providing a low gain feedback path. A pair of summers 1432, 1434 are responsive to the feedback signals on the lines 1428, 1430 and the centering command signal on line 1402 as steered by the steering control for providing difference signals on lines 1436, 1438 indicative of the difference therebetween. It should be understood that one signal of a pair of output signals on lines 1440, 1442 from the precision rectifiers 1406, 1408 will comprise the steered centering command signal on line 1402 and the other will be zero. By zero we mean a command having a magnitude equal to that required to cause the actuator to return to its zero position which will be that position required to maintain at least the desired preload on the primary suspension.

As mentioned, we can use many of the same concepts to control front to back centering by means of a pair of opposed but linked guides such as shown in FIGS. 30 and 34. Since there is no need for two actuators in such an arrangement, we simply sense the position of the car with respect to the roller (the "gap") and feed the sensed gap signal back to a gap feedback control loop that controls an actuator to maintain a desired gap.

Figure 45:
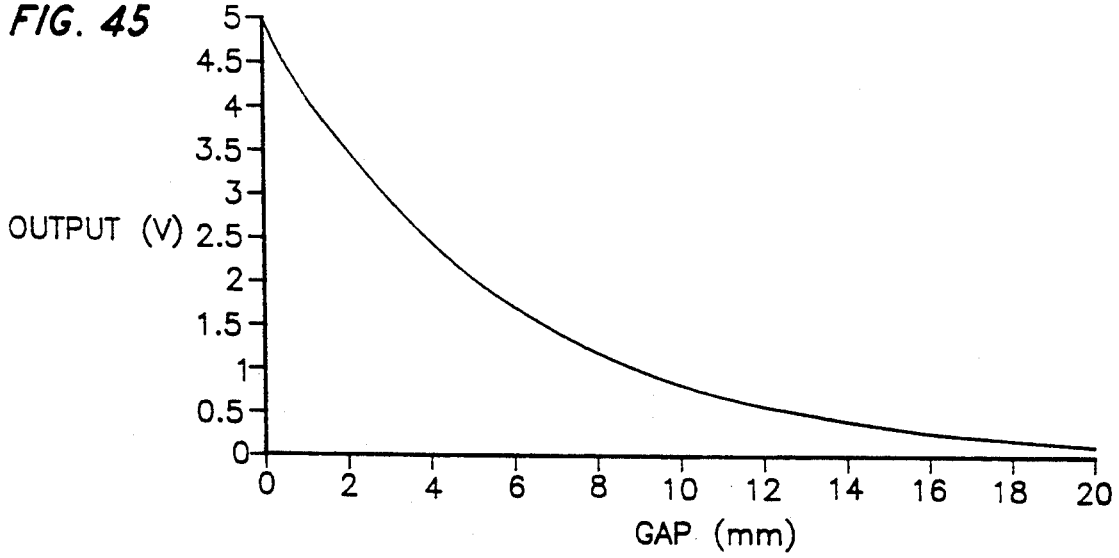
FIG. 45 is an illustration of the response of a single position transducer associated with, for example, each one of the position transducers such as illustrated in FIG. 36.
Figure 46:
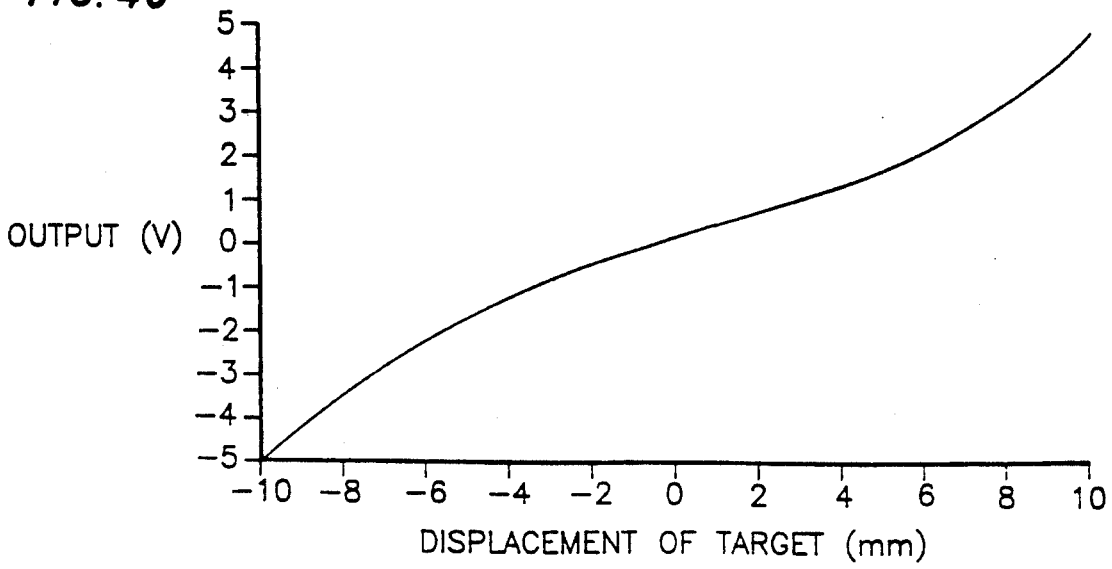
FIG. 46 is an illustration of a composite of two such transducer responses such as might appear on line 698 of FIG. 43.

Referring now to FIG. 45, the response of a position transducer, such as is shown in FIG. 62, is shown. This is an experimentally determined response. Although the response for a particular transducer is shown, it will be realized that any other suitable type of position sensor may be used, including linear position sensors. The summation of the two signals on the lines 1392, 1394 is shown in FIG. 44 over the whole range of displacement of the elevator car (scaled to the particular sensing arrangement we have shown). The positioning of the links on the active guides according to the embodiment shown is such that no more than ten millimeters of displacement is to be expected. Thus, it will be seen that the two position sensors for the corresponding two roller guides can be combined in a seamless response, such as shown in FIG. 46, for representation to the lag filter 1400 of FIG. 43.

Figure 47:
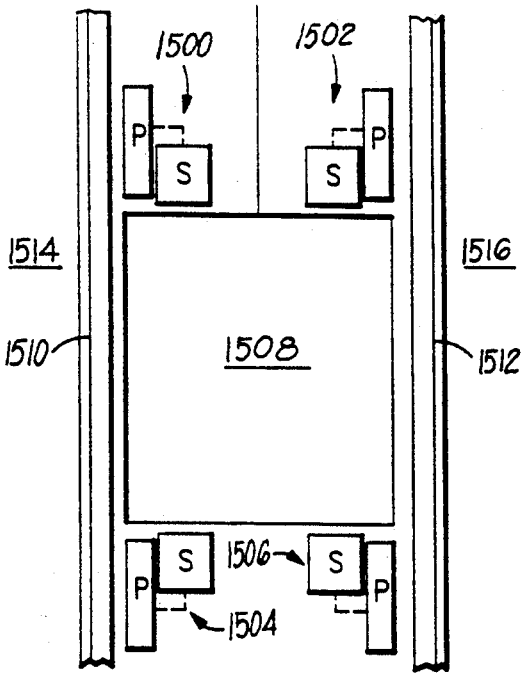
FIG. 47 is an illustration of an elevator car having a plurality of magnetic primary suspensions associated with secondary suspensions, according to the present invention.
Figure 49:
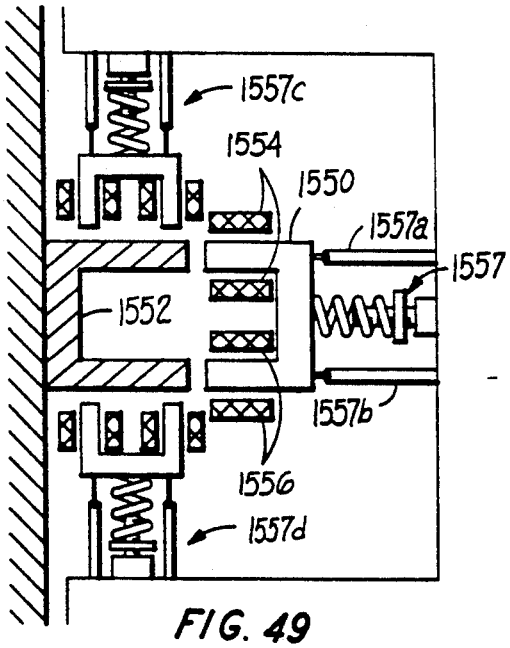
FIG. 49 is an illustration of a long core, such as shown in FIG. 48, oriented for interfacing with a C-shaped rail.

Referring now to FIG. 47, guides 1500, 1502, 1504, 1506 are shown for guiding a car 1508 between a pair of hoistway rails 1510, 1512 attached to hoistway walls 1514, 11516. Each of the guides has a primary suspension comprising an electromagnet labeled "P" and a secondary suspension lableled "S" to which the "P" primary is attached. The primary suspensions may appear as shown in FIG. 48 each with a core 1550 having a length considerably longer than its width which may be oriented with respect to a V or T-shaped rail in a manner similar to the orientation shown in FIG. 15, i.e., with the "C" shape oriented horizontally. This provides good, high-speed performance and more front-to-back guidance force than provided in previously disclosed electromagnetic actuators, such as shown in Kokoku, No. 58-39753 or Kokai 60-36279, which show or suggest rather short cores oriented ninety degrees from the orientation shown in FIG. 15, i.e., with the "C" shape oriented vertically. Regardless of the lengths or orientations of the cores, we teach that the primary suspension associated with the second suspension may be an electromagnet. As shown in FIG. 49, such a core 1550 may be oriented with respect to a C-shaped rail 1552 having a coil 1554 on one leg and a coil 1556 on another leg for providing flux for the flux path comprising the C-shaped rail 1550, the core 1552, and the gaps therebetween. The core 1550 is, of course, attached to a secondary suspension which is in turn attached to a car 1556*a*. In this case, we have shown a ball screw actuator 1557 for pushing on the core with a spring similar to the setup shown previously. In addition, we have shown a pair of stabilization guides 1557*a*, 1557*b*, which may be passive or active, e.g., solenoid operated. If active, they may be used in parallel with the actuator 1557 as an adjunct, to augment stability rail as well for side-to-side stabilization. An additional pair of opposed front-to-back suspensions 1557*c*, 1557*d* are shown as well. Such would also be used in a similar manner on the opposite rail.

Figure 50:
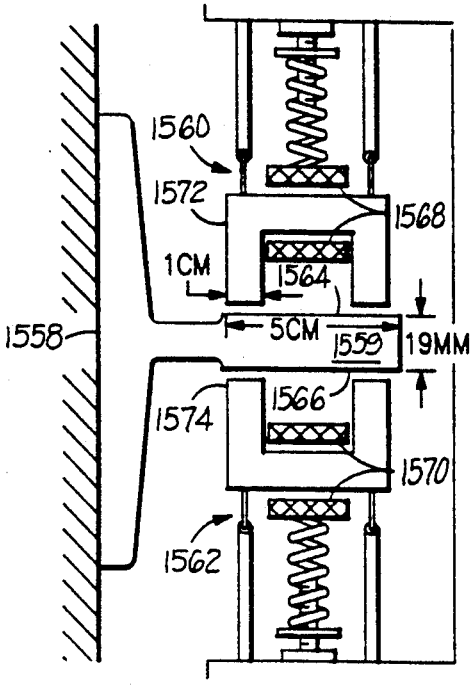
FIG. 50 is an illustration of a pair of long cores, such as shown in FIG. 48, for interface with a standard type rail.

For a more conventional shaped rail 1558, such as shown in FIG. 50, which may, for example, have a dimension of 19 mm for the distal surface of the blade which itself has a length of five centimeters, a pair of electromagnet actuators or electromagnet bearings 1560, 1562 are arranged opposite one another to face opposing surfaces 1564, 1566 of the blade 1559. In this case, a pair of coils 1568, 1570 are wound around the piece that joins the two legs of the respective cores 1572, 1574. For this type of arrangement, the side-to-side control is provided by the natural reluctance of the electromagnets to move side-to-side.

One embodiment of the primary suspension shown in FIG. 50 use score faces one centimeter wide. Assuming the cores themselves are shape like the core in FIG. 48 and have a length of 25 cm and a flux of 0.6 Tesla, the force per core is approximately 716 Newtons of attractive force. This is, of course, a front-to-back force, but the side-toside force available is similar in magnitude without the need for additional electromagnets, if desired, one could use a third rail in the back of the car to help the side-to-side stabilization. A similar pair of cores would be used on that rail as well.

Thus, it will be observed that for the example given, the length of the core is five times longer than its width, although such should not be considered a limitation since this is merely an example, and the intent is to provide a teaching that shows a pole having a length significantly greater than its width. As previously mentioned, the type of electromagnet used is not essential, since various types of primary suspensions have been disclosed, not for the purpose of limitation but for the purpose of showing the wide applicability of the generally concepts disclosed.

Similarly, the primary suspension may be a slide guide for running along guide rails such as shown in FIG. 2*a* and FIG. 2*b* of U.S. Pat. No. 4,750,590 where the guide shoes are laterally controllable using hydraulic cylinders mounted to the elevator car.

Figure 51:
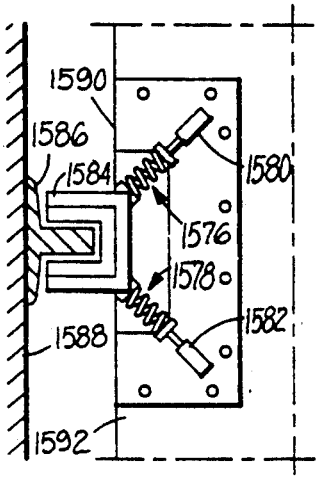
FIG. 51 is an illustration of a sliding guide shoe used as a primary suspension and interfaced with, for example, a plurality of hydraulic actuators.

FIG. 51 shows an alternate primary suspension comprising a guide shoe with actuators canted at 45 degrees, similar to Otala's actuators, as shown in U.S. Pat. No. 4,750,590, except having a pair of springs 1576, 1578 inserted in between the corresponding pair of hydraulic cylinders 1580, 1582 for actuating a guide shoe 1584 which rides on a guide rail 1586 mounted on a hoistway wall 1588. A base or carriage 1590 is mounted on an elevator car 1592. If the designer wishes to avoid the complexities introduced by using nonorthogonal force actuators and is willing to pay the added cost of an additional actuator per rail, he may used three actuators oriented orthogonally in a manner shown previously. For that case, it should be understood that the slide shoe 1584 may, but need not, comprise independent front-to-back and side-to-side shoes as opposed to the integral shoe shown.

Although the invention has been shown and described with respect to an exemplary embodiment thereof, it should be understood that the foregoing and other changes, omissions and additions may be made therein and thereto, without departing from the spirit and scope of the invention.

We claim:

1. A method for horizontally controlling an elevator car by exerting a force between said car and a hoistway rail with an electromagnet in response to a force command signal, comprising the steps of:

sensing flux density between said electromagnet and said rail, providing a sensed flux density signal having a magnitude indicative thereof, squaring said magnitude of said flux density signal and providing a squared flux density signal having a magnitude indicative thereof, multiplying said magnitude of said squared flux density signal by a transformation signal having a magnitude indicative of force per flux density squared for providing a force feedback signal, and summing said force feedback signal with said force command signal for providing a difference signal having a magnitude indicative of the difference therebetween; and exerting a force between a blade of said rail and said car in proportion to the magnitude of said difference signal.

2. The method of claim 1, wherein said rail has a V-shaped section.

3. The method of claim 1, wherein said plural bladed rail has a Y-shaped section.

4. A control for an elevator car actuated horizontally by an electromagnet force actuator, for providing a coil current signal for causing said electromagnet actuator to provide magnetic flux for controlling horizontal accelerations of said elevator car travelling vertically in a hoistway along a rail mounted vertically on a hoistway wall, comprising:

summing means, responsive to a force command signal and responsive to a force feedback signal, for providing a force difference signal having a magnitude in proportion to a difference in magnitudes between said force command signal and said force feedback signal;

current control means, responsive to said difference signal, for providing said coil current signal;

flux density sensing means, responsive to said magnetic flux, for providing a sensed flux density signal having a magnitude indicative thereof;

means responsive to said flux density signal for multiplying said magnitude thereof by itself and by a signal having a magnitude indicative of force divided by flux density squared for providing said force feedback signal;

an accelerometer, responsive to acceleration of said platform, for providing an acceleration signal having a magnitude indicative thereof;

control means, responsive to said acceleration signal, for providing said force command signal in proportion to said magnitude of said acceleration signal.

5. The control of claim 4, wherein said current control means comprises:

compensation means, responsive to said force difference signal for providing a proportionally compensated signal;

a firing angle compensator, responsive to said proportionally compensated force difference signal, for providing a firing signal;

a two quadrant, full wave power controller, responsive to said firing signal, for providing said coil current signal.

6. The control of claim 4, wherein said control means is a digital signal processor and said summing means, said means for multiplying and said current control means are analog.

7. The control of claim 5, wherein said compensation means is for providing a proportional-integral compensated signal.

8. A method for counteracting a disturbing force acting on an elevator platform in a hoistway, comprising the steps of sensing horizontal acceleration and horizontal position of said platform and providing sensed signals having magnitudes indicative thereof and applying a horizontal force between said platform and a wall of said hoistway in proportion to said magnitude of said sensed acceleration signal and in proportion to the integral of said sensed position signal.

9. The method of claim 8, wherein said sensed position signal is a sensed current signal divided by a sensed flux density signal multiplied by a transformation signal having a magnitude indicative of position times flux density divided by current.

10. Apparatus for providing a position signal indicative of a position of a platform actuated by an electromagnet for guiding said platform vertically along and horizontally with respect to a rail and a signal, in response to said position signal, for controlling the electromagnet for guiding said platform, comprising:

means for sensing flux density between said rail and said electromagnet and for providing a sensed signal having a magnitude indicative thereof;

means for sensing current of said electromagnet for providing a sensed signal having a magnitude indicative thereof;

means responsive to said sensed signals for dividing said magnitude of said sensed current signal by said magnitude of said sensed flux density signal for providing a calculated position signal having a magnitude indicative of said position and for controlling said electromagnet in response to said calculated position.

11. The apparatus of claim 10, wherein said means for sensing flux density comprises a Hall cell.

12. Apparatus for controlling a horizontal position of an elevator platform suspended in a hoistway, comprising:

sensor means, responsive to said position of said suspended platform as it moves vertically in said hoistway, for providing a sensed signal having magnitude indicative thereof;

control means, responsive to said sensed signal, for providing a control signal; and reciprocating guide roller actuator means, responsive to said control signal, for horizontally actuating said platform with respect to said hoistway as said platform moves vertically in said hoistway.

13. The apparatus of claim 12, wherein said sensor means comprises a position sensor for sensing a position of said car with respect to a roller of said guide roller.

14. The apparatus of claim 12, wherein said sensor means comprises side-to-side and front-to-back roller sensors.

15. The apparatus of claim 14, further comprising: an accelerometer, responsive to acceleration of said platform, for providing an acceleration signal having a magnitude indicative thereof;

wherein said control means is responsive to said acceleration signal for horizontally actuating said platform in proportion to said magnitude of said acceleration signal.

16. The apparatus of claim 12, wherein said control is responsive to an integrated signal being indicative of an integral of said magnitude of said position signal.

17. Apparatus for horizontally actuating an elevator platform against a rail attached to a hoistway wall, comprising:

plural accelerometer means, responsive to corresponding horizontal accelerations of said platform, for providing corresponding plural acceleration signals indicative thereof; and control means, responsive to said plural acceleration signals, for providing corresponding plural control signals;

a plurality of actuators situated to actuate said platform along horizontal lines which intersect said hoistway wall at equal angles, each corresponding to a selected on of said acceleration signals or to selected components of said acceleration signals which together resolve accelerations along said horizontal lines;

said actuators responsive to said corresponding control signals for actuating said platform along said lines.

18. The apparatus of claim 17, wherein said plurality of actuators comprises for electromagnets arranged in pairs, said pairs located on opposite sides of said platform.

19. The apparatus of claim 17, wherein said plurality of actuators is a plurality of electromagnets each having a core and a coil, and wherein said apparatus further comprises:

plural sensor means, responsive to magnetic induction in a gap between each of said electromagnet cores and said rail, for providing a flux density signal having a magnitude indicative thereof; and wherein said control means comprises:

first control means responsive to said acceleration signals and to a plurality of force feedback signals for providing said plural control signals as corresponding force command signals and plural second control means responsive to said flux density signals from corresponding ones of said plural sensor means, for multiplying said magnitude of each flux density signal by itself and by a factor having dimensions of force divided by flux density squared in order to transform said flux density signal and to provide a transformed flux density signal as a corresponding one of said force feedback signals for comparison with a corresponding one of said force command signals wherein a difference therebetween is provided as a current signal for a corresponding coil for inducing flux in a corresponding core for providing said magnetic induction for actuating said platform.

20. The apparatus of claim 17, wherein said plurality of actuators is a plurality of electromagnets each having a core and a coil, and wherein said control means comprises:

first control means, responsive to said acceleration signals and to a plurality of position signals for providing said control signals as corresponding force command signals; and a plurality of second control means, each responsive to a corresponding one of said force command signals, for providing corresponding coil current signals for a corresponding coil for actuating said platform against said rail, wherein each of said second control means includes a current sensor for sensing said coil current for providing a sensed coil current signal, and wherein each second control means is responsive to a corresponding one of said second current signals, and wherein each of said second control means is also responsive to a sensed magnetic induction signal, for providing a corresponding one of said position signals indicative of a position of said platform.

21. The apparatus of claim 18, wherein each of said electromagnets has a U-shaped core having a pair of legs each wound with said coil responsive to a corresponding one of said control signals.

22. The method of claim 1, wherein said rail has a T-shaped section.

23. A method for exerting a horizontal force between a hoistway rail and an elevator car with an electromagnet attached thereto for providing, in response to a command signal, magnetic flux to said hoistway rail, comprising the steps of:

sensing flux density between said electromagnet and said rail, for providing a sensed flux density signal having a magnitude indicative thereof, sensing a current for actuating said electromagnet, for providing a sensed current signal having a magnitude indicative thereof, dividing said magnitude of said current signal by said magnitude of said flux density signal for providing a factor signal having a magnitude indicative thereof;

multiplying said magnitude of said factor signal by a transformation signal having a magnitude indicative of position times flux density divided by current for providing a position feedback signal, summing said position feedback signal with said command signal for providing a difference signal having a magnitude indicative of the difference therebetween, and providing said current for exerting said force between said rail and said car in proportion to the magnitude of said difference signal.

24. Apparatus, for controlling a horizontal force between a hoistway rail and an elevator car with an electromagnet attached thereto for providing, in response to a reference signal, current to said electromagnet for providing magnetic flux between said electromagnet and said hoistway rail, said apparatus comprising:

a magnetic flux density sensor for sensing flux density in a gap between said electromagnet and said rail, for providing a sensed flux density signal having a magnitude indicative thereof, a current sensor sensing said current provided to said electromagnet, for providing a sensed current signal having a magnitude indicative thereof, signal conditioning means, responsive to said sensed flux density signal and to said sensed current signal, for dividing said magnitude of said current signal by said magnitude of said flux density signal and for multiplying a quotient therebetween by a scale factor for providing a gap signal having a magnitude indicative of a linear dimension of said gap;

a multiplier, responsive to said gap signal and a transformation factor signal, for multiplying said magnitude of said flux density signal by itself and by a transformation factor signal for providing a force feedback signal, and means for summing said force feedback signal with said reference signal having a magnitude indicative of a force for providing a difference signal having a magnitude indicative of the difference therebetween; and means for providing said current to said electromagnet for controlling said flux between said rail and said electromagnet in proportion to said magnitude of said difference signal.

25. The control of claim 4, further comprising:

current sensing means, responsive to said coil current signal, for providing a sensed signal having a magnitude indicative thereof;

a divider, responsive to said second flux density signal and to said sensed coil current signal, for dividing said magnitude of said sensed coil current signal by said magnitude of said sensed flux density signal for providing a factor signal having a magnitude indicative thereof;

a multiplier, responsive to said factor signal and to a transformation signal, for multiplying said magnitude of said flux density signal by a transformation signal having a magnitude indicative of position times flux density divided by current, for providing a position feedback signal having a magnitude indicative of the magnitude of a gap between said electromagnet and said rail;

wherein said control means is responsive to said position feedback signal and to a position reference signal, for providing a position difference signal having a magnitude indicative of the difference therebetween; and wherein said control means is responsive to said acceleration signal and to said position difference signal for providing said force command signal.

* * * * *